US008561219B2

(12) United States Patent
Metcalf et al.

(10) Patent No.: US 8,561,219 B2
(45) Date of Patent: Oct. 22, 2013

(54) POSITIONABLE ZERO-FOOTPRINT SELF-CLEANING URINAL AND VERY LOW WATER-USAGE MIST-DISPENSING MEANS

(76) Inventors: Darrell Jay Metcalf, San Anselmo, CA (US); Clyde LeRoy Tichenor, Somis, CA (US)

( * ) Notice: Subject to any disclaimer, the term of this patent is extended or adjusted under 35 U.S.C. 154(b) by 10 days.

(21) Appl. No.: 13/253,051

(22) Filed: Oct. 4, 2011

(65) Prior Publication Data

US 2012/0079650 A1 Apr. 5, 2012

Related U.S. Application Data

(60) Provisional application No. 61/404,349, filed on Oct. 4, 2010.

(51) Int. Cl.
*E03D 13/00* (2006.01)

(52) U.S. Cl.
USPC ..... 4/307; 4/311; 4/312

(58) Field of Classification Search
USPC ..... 4/307, 311, 312
See application file for complete search history.

(56) References Cited

U.S. PATENT DOCUMENTS 2,879,519 A * 3/1959 Mueller ..... 4/312

FOREIGN PATENT DOCUMENTS

GB 2436838 A * 10/2007

* cited by examiner

*Primary Examiner* — Tuan N Nguyen

(57) ABSTRACT

A self-rinsing urinal and very low water-usage mist-dispensing means mountable in close proximity to a normally-interior portion of at least one positionable panel configured slidably or pivotally positionable from an opening of customary cabinetry of a room or a wall. The urinal is positionable from the customary cabinetry or wall opening, between a zero-footprint concealed state and a revealed-for-use state, such that an interior receptacle surface of the urinal is aligned with said very low water-usage mist-dispensing means during at least a revealed-for-use state, to receive from the mist-dispensing means a distributed misted spray aligned with the receptacle, to repel waste-liquid from and facilitate a self-rinsing of the receptacle while employing as little as single-digit ounce(s) of water, per use-cycle. Certain of the embodiments include the option to provide actuating means for positioning and/or aligning one or more urinal-related components in response to receiving a control signal.

25 Claims, 14 Drawing Sheets

POSITIONABLE ZERO-FOOTPRINT SELF-CLEANING URINAL AND VERY LOW WATER-USAGE MIST-DISPENSING MEANS

CROSS-REFERENCE TO RELATED APPLICATION

The present invention is a non-provisional patent application that relies on disclosure within provisional patent application Ser. No. 61/404,349 filed Oct. 4, 2010.

FIELD OF THE INVENTION

The present invention relates to the field of low water-usage urinals. More particularly, the invention pertains to water, energy and space saving urinals configured with very low water-usage mist-dispensing or emitter means relatively alignable with a selectively concealable and revealable urinal receptacle to facilitate a self-cleaning of the receptacle, while providing greater than 90% water savings over standard 1.0 gallon per flush ('GPF') low water-usage urinals. Preferred embodiments of the water, energy and space saving urinals are positionably installable within customary cabinetry of a room, or a wall of a room, which when normally-concealed, occupy little or no additional space within the room.

BACKGROUND OF THE INVENTION

One of the most significant changes seen in recent years, relating to products having an impact on water-usage, is in the growing need to conserve water, especially in those areas or regions having high-density populations and/or drier climates. Accordingly, products associated with water-usage such as urinals, toilets, faucets, showers, bath tubs, spas, swimming pools, agriculture, gardening and irrigation-related products, and the like, have been given increased attention to see how improvements might be made to better conserve, and/or reduce unnecessary wasting of, water.

In recent years, one approach taken with urinals was the development, production and marketing of waterless urinals, which clearly had as their primary objective a significant reduction in water-usage. However, for many users, the 'waterless' approach has proved less than satisfactory, due in part to waterless urinals not being truly or completely self-cleaning and thus tending to accumulate unpleasant odors, that often linger in their vicinity. For example, a number of waterless urinals were marketed touting a maintenance-free self-cleaning aspect, wherein a urinal receptacle was made having a Teflon® or other water-repelling surface or coating, however it was found that even small amounts of urine retained on such surfaces and about the drains, or drain outlets of the urinals was enough to produce mildly to strongly unpleasant odors. If the urinals were installed in a facility where there were many urinals in one enclosed area, for example mounted side by side along a long wall of a large restroom, the odor problem was likely to be compounded proportionate to the number of urinals and their degree of use. Attempts have been made to overcome waterless urinal odor problems with various maintenance-related (not 'maintenance-free') approaches, each of which has corresponding, if not unanticipated, increased personnel and operational costs. For example, to address the problem of urine sticking to, or being retained on, one or more surface areas of a waterless urinal receptacle surface, maintenance personnel, and one or more cleaning solvents, had to be allocated to provide for regular maintenance-related cleanings. To address the problem of odor related to urine retained on and about the drains, or drain outlets of waterless urinals, various solvents, gels or solutions were proposed, sold and employed by staff newly delegated to waterless urinal maintenance tasks. Nonetheless, such attempted solutions have not always proven satisfactory. For example, it was reported in recent news articles, that some government facilities at the local and state level, having previously had waterless urinals installed, had odor related problems that proved so unsatisfactory the facilities had all the waterless urinals removed. Another limitation related to waterless urinals pertains to a military urinal construction standard which prohibits waterless urinals being connected to plumbing made of copper material due to problems with corrosion. As plumbing often includes copper components the waterless urinal was not an ideal option for military installations.

While the waterless urinal approach is effective in reducing water-usage, and has otherwise had some limited successes, for example when in installed in certain well-vented environments, it has not proven to be a likely candidate for wide adoption, or for replacement or retrofitting of urinals installed in facilities that do use water and are already equipped with drainage to standard sewer lines.

With such problems hindering widespread acceptance, and use, it is questionable as to whether the waterless urinal approach will in the end account for much in the total reduction of urinal water-usage.

In a more conventional approach, the standard reduced water-usage urinals, such as the types already employed in many commercial, government, military, institutional and public facilities are not ideal either, in that a multitude of them operate at an older 'low-flush' standard of one gallon per flush ('1 gpf'). Similarly many toilets, even those equipped with a reduced water-volume urine flush-cycle operate in a comparable range using far more water per flush than is necessary.

The high water-usage problem associated with the toilet usage is multiplied by another factor that is not likely to change quickly under status-quo construction practices. This is to a significant degree due to a utilitarian design approach taken with many, if not most, restrooms or bathrooms, wherein, once built, there is little additional space left to accommodate the adding of a typically configured urinal. For example, in addition to the room occupied by a relatively high water-usage toilet, customary cabinetry, for example including a sink with a faucet or two and one or more doors or drawers, will be installed with perhaps a bathtub or shower stall in the same room, often with minimal maneuvering space being left between such fixtures. Consequently, in a majority of bathrooms, the toilet, whether equipped with a lower water-usage urine flush-cycle or not, remains the typical means for the capturing and dispensing of liquid waste. Some people practice a type of makeshift water-conservation by employing a standard toilet and not flushing between urination-only use-cycles, however after only a few urine-accumulating cycles a strong unpleasant odor can easily be generated. More often existing restrooms have older model toilets installed having no better than a 3 to 5 gallon per flush rate.

In contrast, the present invention provides a relative aligning between a positionable urinal receptacle and/or very low water-usage mist-dispensing (or emitter) configurable to flush, for example, 13 to 20 use-cycles for every gallon of water used, with each use-cycle facilitating an odor-controlling self-cleaning of the urinal. Accordingly, a user employing a urinal, or retrofittable urinal, of the present invention could yield 60+ use-cycles for every time a typical 4-5 gallon toilet in his home might otherwise be used and flushed just once. While it is understandable that toilets are necessary for handling non-liquid waste in addition to liquid waste and consequently require more water when doing so, it can be seen that the toilet-only approach in homes, offices and public places, and the long-standing practice of building so many bathrooms and restrooms having only toilets, are among the biggest factors preventing a substantial, and otherwise easily obtainable reduction in water-usage.

Moreover, as almost anyone can attest, the ubiquitous toilet-only fixture does not come equipped to provide a self-cleaning, or clean-while-in-use feature. Whether installed in homes or in public venues they require their respective residents, or paid professionals, to do regular toilet cleanings with the added cost of cleaning related products.

Another problem is that of aesthetics, wherein it might be considered reasonable to ask, "How come a urinal has to be seen?" Although some attempts made in prior art approaches were aimed at concealing a urinal that could be partially or fully hidden between use-cycles, little to no water and energy savings was achieved over typical urinal configurations, due to the prior art incorporating a standard, or fairly typical, water-flushing means. In contrast, the concealable and revealable urinals of the present invention are configured with very low water-usage mist-dispensing or emitter means relatively alignable with a fully concealable urinal receptacle, to provide for example, 13 to 20 flush cycles, or use-cycles, for each gallon of water used.

It is noted that improved means for significantly or substantially reducing water-usage can also accrue significant savings in energy-usage, as a common method of distributing water often entails the use of energy-consuming water pumps. Accordingly, substantial decreases in water usage can mean significant reductions in energy use. Thus, an incorporating of the urinal of the present invention, depending on the components employed in its mist-dispensing or emitter means, can save for example 90-95% of the water-pumping energy consumed by a standard one-gallon per flush urinal. Accordingly, a substantial improvement in reduced water and energy consumption is provided by the present invention versus prior art approaches.

Another important factor, often largely unaddressed, is the impact on the environment from too much demand for water, or from entirely depleting certain water resources. Such practices have taken, and continue to take a toll on natural habitat and wildlife, in some cases causing: collapsed aquifers; loss of habitat; substantial dust particulate production from water being diverted (to the detriment of one environment) to meet the demand of people in another environment; substantial increases in water bills for residences, businesses and farms; and so on. There are some projections now being made that water resources may become one of the most fought-over resources in the near future. Even the flushing of too much wastewater, including wastewater into septic systems is a real concern. For example, material published by the Environmental Protection Agency entitled "A Homeowner's Guide to Septic Systems" states: "With one-fourth of U.S. homes using septic systems, more than 4 billion gallons of wastewater per day is dispersed below the ground's surface. Inadequately treated sewage from septic systems can be a cause of groundwater contamination. It poses a significant threat to drinking water and human health because it can contaminate drinking water wells and cause diseases and infections in people and animals. Improperly treated sewage that contaminates nearby surface waters also increases the chance of swimmers contracting a variety of infectious diseases. These range from eye and ear infections to acute gastrointestinal illness and diseases like hepatitis." And, "Average indoor water use in the typical single-family home is almost 70 gallons per person per day. Leaky toilets can waste as much as 200 gallons each day. The more water a household conserves, the less water enters the septic system. Efficient water use can improve the operation of the septic system and reduce the risk of failure. And lastly, "Toilet use accounts for 25 to 30 percent of household water use . . . . Most older homes have toilets with 3.5 to 5-gallon reservoirs, while newer high-efficiency toilets use 1.6 gallons of water or less per flush."

As the prior art space-saving concealable and revealable urinal approaches have not adequately addressed the need to substantially reduce water usage and wastewater, and substantial improvement is quite feasible, it would be advantageous to provide the alternative of the present invention's space-saving, very low water-usage, positionable urinals, configured to facilitate self-cleaning. As the urinal embodiments of the present invention are designed installable or retrofittable within a wall of a room, or customary cabinetry of a room (i.e., cabinetry providing one or more customary cabinet functionalities) without adding, or encroaching into, the space of a room, almost any existing bathroom (or room or wall near a drain or sewer pipe) can be equipped or retrofitted with a concealable urinal configured to reduce water-usage by an order of magnitude.

Other efforts have been made to incorporate a urinal functionality into a restroom in a space-saving manner, for example, by making a toilet, urinal, or urine capturing plate of a urinal, positionable from a wall recess, or by making an installable urinal-specific cabinet which can be added onto and extend outwardly from a wall encroaching into a room. For example, in U.S. Pat. No. 4,488,321, Brunton discloses a urinal made to be installed within a wall recess having a vertically-arranged side opening, wherein the urinal is concealable behind hinged doors in the recess, but is otherwise "flushed by a conventional water supply" dispensed from fixed plumbing mounted internally within the wall recess. As the Brunton urinal is also mounted in a fixed position within the wall recess it can be seen that neither the urinal nor water-dispensing means are positionable. A pivotal flip guard is provided to rotate outwardly wherein a "forward edge surface projects beyond the boundary of said receptacle through the open front thereof" but less than a few inches, meaning a user's face would correspondingly be only a few inches from the wall, which would not provide an ergonomically comfortable distancing or typical user experience. This can be seen in the subsequent Preferred Embodiments of the Present Invention section of this specification wherein a description in reference to the FIG. 8 "Prior Art" drawing, contrasts a user's position, and ergonomics, from a wall when employing Brunton's fixed higher-than-deep urinal opening and nominally-extending drip guard plate (shown proportionately scaled to fit within a standard stud depth) against a positionable deeper-than-high urinal-receptacle embodiment of the present invention shown in FIGS. 9A and 9B. Accordingly, in addition to the Brunton invention not having means for substantially reducing urinal related water-usage, it can be seen that user comfort and ergonomics could be much less appealing due to a vertically-aligned urinal opening (flush with a wall) approach which determines a close proximity of the user to the wall opening. In contrast, the present invention provides space-saving positionable urinals equipped with very low water-usage mist-dispensing means wherein a majority portion of a generally upward-facing opening of the receptacle is ergonomically extended out from a wall having an ergonomically improved accessibility providing a familiar distancing and customary urinal experience.

In another approach, U.S. Pat. No. 2,076,950 describes a manually positionable, 'Disappearing Toilet' (not a urinal), however Koch does not show a toilet or urinal equipped to provide flushing in a substantially reduced water-usage manner.

In U.S. Pat. No. 7,331,068 issued to one of the applicants of the present invention, a urinal is described having a single fixed mister located centrally above a urinal receptacle with the entire urinal configured mountable in a stationary manner extending outwardly from an exterior wall surface. Accordingly, the embodiments of the issued patent are not ideal for installation or retrofitting in many bathrooms designed to be economical in space, and the positionable urinal embodiments of the present invention, installable within an interior volume of existing customary cabinetry or a wall of such rooms, would provide a significantly improved water-use reducing alternative. As any embodiment of the issued urinal patent is mounted in a fixed manner, and is not configured with very low water-usage mist-dispensing means separately positionable between reduced-profile and extended-profile states, or positionable in concert with a urinal at a fixed height, a urinal positionable between a concealed, zero-footprint state (within an interior volume of customary cabinetry or a wall) and an extended-for-use state is not provided. Thus it would be advantageous to additionally provide urinals that are concealable and revealable, and equipped to provide relative alignment between a positionable urinal receptacle and very low water-usage mist-dispensing means (whether fixed in height or made separately positionable) to collectively provide a distributed mist spray volume which facilitates urinal self-cleaning and use in a water, energy and space saving manner, and it is among the objects of the present invention to provide such improved solutions.

In U.S. patent application 2006/0168718 (abandoned) by Watson et al, the application describes a urinal-specific enclosure mountable on a wall to conceal or provide, via doors, access to either a wall-mounted urinal, or a portable urinal, wherein the latter must be entirely removed from the enclosure for use. While a concealable urinal is described (having no water supply or flushing means), the enclosure is merely added onto a wall of a room and thereby necessarily extends into, or encroaches on, the space of the room. Thus, the application has no means for reducing the water-usage of water-flushed urinals, and no space-saving aspects of its concealable urinals.

None of the prior art approaches have incorporated, anticipated or proposed a space-saving solution that also addresses the growing demand to significantly or substantially reduce water-usage or the unnecessary wasting of water. More particularly, none of the prior art have incorporated the present invention's very low water-usage mist-dispensing means, positionable in concert with, or positionable into alignment with, a urinal-receptacle surface of a positionable concealable and revealable urinal configured to provide a distributed misted spray volume positionably aligned to prevent retention of waste liquid on, and provide a self-cleaning of, the urinal-receptacle surface in very low water usage manner (e.g., saving water 90% or more versus a standard low-water 1 gallon per flush urinal).

Accordingly, it would be advantageous to address the shortcomings of Brunton, Koch and Watson et al, and deficiencies of other prior art approaches, by applying the present invention's space-saving, positionable urinal improvements and embodiments mentioned above and those described in the sections to follow, thus it is among the objects of the present invention to provide such improvements and embodiments.

SUMMARY OF THE INVENTION

A space-saving, very low water-usage, positionable urinal configured to facilitate self-cleaning of a urinal-receptacle is provided (hereinafter referred to in a simplified form as 'urinal') which is configured relatively alignable with a fixed or positionable, very low water usage mist-dispensing means having one or more misters, or mister-like elements, equipped to provide or induce a misted-spray, misted-fog or mist. Alternatively, very low water usage emitter means may be equipped with one or more very low-water usage emitters configured to radially spray a plurality of fine water streams which upon impact with a side of a urinal-receptacle surface each generate a splatter-induced mist which collectively provides widespread mist-dispensing within the urinal-receptacle. Hereinafter the term 'mister' whether used in the singular or plural refers to very low water-usage mister(s), mister-like element(s) or a component or element configured to emit or induce a mist e.g., comprising micro-droplets. One or more portions of the urinal, or a urinal-receptacle, are attachable with a normally interior-facing portion of a positionable panel (or attachable with a structural member associated and movable with the panel) such that an interior urinal-receptacle surface, positionable in concert with, or relatively alignable with, mist-dispensing means, receives at least during a use-cycle, a distributed misted spray volume aligned to prevent retention of waste liquid on, and facilitate a self-cleaning of, the interior urinal-receptacle surface in an efficient, very low water usage manner. The positionable panel is pivotally mountable adjacent to, or made slidably operable at: an opening of existing, modified or newly-added customary cabinetry of a room; or, an opening of a wall (such as a wall of a room), such that, when the urinal is in a normally-concealed or closed state it occupies little or no additional space in the room. During a urinal use-cycle, alignment between the positionable urinal-receptacle and mist-dispensing means provides a capturing of the distributed misted spray volume, and the urinal-receptacle is equipped to convey waste liquids out from one or more liquid-conducting outlets. For example, waste liquids can be channeled, gravity-fed or siphoned from one or more urinal-receptacle outlets coupled with a conduit leading to a typical drain or sewer pipe, or a coupling configured to receive an end or extended portion of the conduit (e.g., a coupling having standard pipe coupling means), or other waste-liquid capturing means. An advantageous siphoning aspect can be provided by a locating of the outlet end of a waste-liquid conduit at a point which is lower than any preceding portion of the conduit. In a preferred embodiment a generally upward-facing urinal-receptacle of the urinal is further configured to be positionable in concert with, or positionable into alignment with, very low water-usage mist-dispensing means, to receive, for example during a use-cycle, a distributed misted spray volume. Optionally, an upper portion of a urinal-receptacle or adjacent upper portion of the urinal may be configured with a generally upwardly-extending splash or guard plate which faces a user during a use-cycle. The splash plate can be configured stationary, positionable, or positionable in concert with a urinal-receptacle (and any associated positionable components thereof) and is preferably located near a rear portion of an upper opening of the urinal-receptacle to facilitate waste-liquid capture.

The term "distributed misted spray volume" as used herein refers to a misted spray volume emitted from one or more misters or induced by one or more emitters, which is positionably alignable separately from, or positionably alignable in concert with, a urinal-receptacle in a manner preventing retention of waste liquid on, and facilitating self-cleaning of, an interior surface of the urinal-receptacle, in an efficient very low water-usage manner. For example, efficiency in the self-cleaning aspect of the urinal is increased by aligning the misted-water particles, or mist-fog particles (micro-droplets)

of the distributed misted spray volume so that they come into widespread contact, or total contact, with the urinal-receptacle surface at a very low water-usage rate, which pre-conditions the surface prior to use and/or conditions the surface during a urinal use-cycle in a manner which facilitates a repelling of waste liquids from the urinal-receptacle surface. The term "use-cycle" as used herein refers to any portion of the duration when a urinal-receptacle receives a micro-droplet 'wetting' from the mist-dispensing means whether in a continuous or intermittent manner.

The efficiency of the positionably aligned distributed misted spray volume, comprising micro-droplets, facilitates the positionable urinal's very low water-usage. For example, during a use-cycle and optional post-use cleaning cycle (including for example, up to a 30 second post-use cleaning) embodiments of the present invention having mist-dispensing means configured to apply a distributed misted spray volume typically utilize a single-digit percent of the water employed by 1 gpf urinals. If the post-cleaning cycle is reduced, or any intermittent or positionable application of micro-droplets is applied, then further, significant or substantial water-usage reduction is achieved. For example, some of the embodiments of the present invention include mist-dispensing means, having one or more misters or emitters that are configured positionable during a use-cycle (e.g., by suitable electro-mechanical, pneumatic or hydraulic-pressure actuating means) such that each in a plurality of sub-sections of a urinal-receptacle surface is repeatably and cyclically wetted with a mist cumulatively providing the aforementioned fixed distributed misted spray volume, with further significantly reducing water-usage. To apply successive and/or cyclic mist distribution over a urinal-receptacle surface, the positioning of a mist-dispensing means, or one or more misters or emitters thereof, may include, but is not limited to, any one or more of the following types of movements: sliding, pivoting, rotating, swiveling, circular, oscillating, spinning, swirling, and the like. For example, in the case of a mister being configured rotatably positionable, the mister can be equipped to provide a reduced misted-spray volume which covers only a portion of a urinal-receptacle e.g., a round-shaped spray pattern having a diameter extending from a central drain up a side of a generally hemispherical receptacle to an upper perimeter, rim or lip. Imparting a rotating movement to the mister (with suitable positioning means) while emitting the round-shaped spray at an offset angle relative to a vertical axis of the receptacle, causes the round-shaped spray pattern to follow a 360° circular path around the interior surface of the receptacle, which in turn provides a distributed misted spray volume for each completed 360° cycle. Optionally, additionally or alternatively, mist-dispensing means may be configured with one or more misters configured, or adapted; to emit an intermittent, or pulsed, supply of water, wherein still further reduction in water-usage can be achieved.

In certain embodiments of the present invention, positionable very low water-usage mist-dispensing means may be equipped or configured in different ways. For example, a plurality of misters or emitters may be configured adjacent, proximate, or near to one another e.g., mounted on a mist-dispensing means support member aligned in a fixed, or positionable manner to collectively emit a distributed misted spray volume. Alternatively, a plurality of misters may be distributed e.g., evenly spaced, along an arced, curved, annular or perimeter portion of a urinal-receptacle. For example two very low water-usage misters can be mounted approximately across from one another on a receptacle trim and aligned to collectively emit a distributed misted spray volume. In any of the embodiments, one or more of the misters may optionally be equipped with an adjacent mist deflecting member shaped to direct, or deflect a side portion of misted or sprayed water into conformance with a distributed misted spray volume. For example, a plurality of misters can be mounted in a distributed manner around a annular water conduit mounted adjacent to an upward-facing urinal-receptacle opening with a deflector mounted above each mister such that an upper side portion of misted-water emitted from each of the misters e.g., a cone-shaped volume is deflected downward so that misted water emitted across the receptacle from each mister is directed (or deflected) below the upper rim of the receptacle.

Mist-dispensing means support members, and any tubes thereof are configurable in different ways, for example made with: different materials, different shapes, contours, cross-sections, or profiles, and may optionally be mounted within a reinforced tamper-preventative outer sheath, for example, for use with fixed or positionable urinals installable in public facilities. While in some of the accompanying drawing figures fixed, or positionable mist-dispensing means support members are depicted as an inverted, generally L-shaped tube with a mister mounted at an end of the tube and aligned to emit a downward directed distributed mist spray volume, it is noted that numerous other tube shapes, contours or profiles; support member configurations; and, mister arrangements, are also possible. For example, a portion of a positionably alignable support member can include an upper arc shaped contour, such that when the support member is pivotally or rotatably positioned to a reduced-profile state the arced contour portion is alignable with an arced portion of an upper opening, or arced perimeter portion, of a urinal-receptacle; and when the support member is pivotally or rotatably positioned to a mist-dispensing state one or more misters mounted at or near the end of the support member are aligned to emit a distributed misted spray volume.

Positionable drawer-like or door-like panels of the present invention are configurable in different ways and with any one or more among a variety of different materials. To illustrate a number of these variations and their respective aspects several examples are provided in the following text. Positionable panels can be made with a material which is the same as, or with a surface material matching, complementing or similar in appearance to, the customary cabinetry, or the wall, on which it will be positionably mounted. Manually positionable door-like panels or drawer-like panels may be equipped with an outward-extending grip, handle, knob or the like, or a recessed handle or grip, to facilitate manually moving the positionable panel and associated positionable urinal and mist-dispensing means between a closed state and an opened state. Positionable panels can be made having the appearance of a door or drawer typical of, complementing, or matching, the customary cabinetry, or the wall, on which they are made to be mounted. Positionable panels can be made for retrofitting onto, or for replacing a drawer or door of, existing customary cabinetry of a room, or can be made during the manufacturing of customary cabinetry as one of its stock components. Positionable panels are preferably made pivotally or slidably mountable such that a positioning of a panel to a fully closed position is done in a space-saving manner, extending outwardly into a room no further than a typical closed door or drawer of the customary cabinetry, or the wall, on which it is made to be mounted. Accordingly, positionable urinals equipped with substantially reduced water-usage or water-saving means are provided that can be added to customary cabinetry of a room, or a wall of a room, which, when normally concealed behind a positionable panel will not occupy any additional space of the room. This aspect of the present invention is particularly advantageous when employed in rooms that are already designed to be: small; compact; utilitarian; equipped with code standardized walls and studs; too small for, or otherwise not well suited for an adding of plumbing-related fixtures, appliances or furnishings; equipped, updated or retrofitted with one or more substantially reduced water-usage urinals; small restrooms, restrooms or lavatories of ground, water, rail and air transportation or recreational vehicles, particularly where the volume and/or weight of transported water is a concern, and/or where substantially reduced-water usage is directly translatable into one or more of the following: reduced fuel cost, increased mileage, reduced electricity usage (energy savings); increased payload, increased cargo, an increased number of passengers, increased storing space, decreased cleaning-related costs, and the like.

It is noted that while the previous descriptions have referred to an installing or retrofitting of a positionable urinal within an opening of customary cabinetry or of a wall, that alternatively urinals of the present invention can be configured for use in other openings, such as an: architectural opening; a pocket door opening; a framed opening; or in a wall of an recreational vehicle such as an aircraft, boat, car, trailer, tent-trailer, tent, or a portable restroom or outhouse, and the like.

Preferably positionable panels are made such that a normally interior-facing side portion of a panel (mountable on a wall, or on customary cabinetry), or interior-facing side portion of an existing door or drawer of customary cabinetry of a room, is configured, or adapted, for mounting or releasably attaching a space-saving, very low water-usage, positionable and self-cleaning urinal. In one approach, tall positionable panels are provided, such as a full-height cabinet door or drawer installable on customary cabinetry. In this 'full-height' approach mist-dispensing means can be mounted in a fixed manner to, adjacent or near the urinal, and a normally interior-facing side portion of a positionable panel attachable to customary cabinetry, or to a wall, is configured or adapted for mounting, or releasably attaching, the urinal and mist-dispensing means, so that the two are pivotally, or slidably positionable together as a unit, and an upper portion of the mist-dispensing means determines the height of the urinal. In other approaches, reduced-height positionable panels are provided. In this 'reduced-height' approach, a normally interior-facing side portion of a positionable panel of customary cabinetry, or a wall, can be configured or adapted, for mounting or releasably attaching, mist-dispensing means configured to be moved, by suitable positioning means, between: a reduced-profile storing state equal to, or less than, the height of the positionable panel; and, a mist-dispensing state higher than positionable panel, and wherein the latter positioning brings one or more misters into operative alignment with the interior urinal-receptacle surface to provide a distributed misted spray volume. In this embodiment, a vertical space-saving aspect is provided, wherein the urinal height is taller than the positionable panel when extended outward for use in an extended-profile state, but is equal to or shorter than the positionable panel when the panel moved to a closed reduced-profile storing state.

Alternatively, in another embodiment, a different, or additional space-saving aspect can be provided, by making a urinal-receptacle, or portion thereof, with one or more durable and flexible materials, or other material adapted to provide repeated expansion and contraction cycles, such that at least an upper receptacle portion and urinal-receptacle opening are extendable and contractible in depth. It is noted that any of the urinal-receptacles of the present invention can be made of one or more materials having a water-phobic and/or liquid-repelling properties, or such properties when conditioned by a distributed misted spray volume. Preferably wall-mountable positionable urinal embodiments of the present invention (whether flexible or rigid) are made having a width which fits the standard spacing between two vertical studs; and made having a depth (or adjustable depth) which fits within the standard depth of a stud e.g. less than 4 inches. In the flexible urinal-receptacle embodiments, an upper front portion of a flexible urinal-receptacle is made attachable to a normally interior-facing portion of a positionable panel; a lower portion of the urinal-receptacle is preferably supported by a frame or one or more support members; and, a rearward-upper portion of the urinal-receptacle is restricted or limited in movement by suitable retaining means. For example, an upper rearward-facing portion of the flexible urinal-receptacle can be made attachable with or securable to, one or more members of, or interiorly mounted to, the inside of a wall. Accordingly, when a positionable panel is configured with a flexible urinal-receptacle and moved from a closed position to an opened position, a front portion of the flexible urinal-receptacle attached with the panel is pulled and expanded outwardly causing a majority portion of an upward-facing opening of the urinal-receptacle to extend exteriorly out from the wall, while a rear portion of the receptacle is retained generally in place or restricted in its movement; and, a depth-extendable urinal-receptacle is provided. To favorably predispose an upper portion, or upper-opening of a flexible urinal-receptacle to assume a specific size and shape, an upper portion of the receptacle can be configured to receive and retain a pre-formed receptacle-opening shaping member. For example, an upper portion of a flexible urinal-receptacle can be formed or molded around receptacle-opening shaping member; or made with an annular retaining lip or recessed channel sized to receive and retain a shaping member; or be configured with a plurality of fastening means distributed around an upper perimeter portion of a flexible urinal-receptacle, each sized to retain a portion of a shaping member, and so on. The receptacle-opening shaping member may be an oval, round or hoop-shaped material, spring, coiled or tubular material which completely encircles an upper portion of the flexible urinal-receptacle; or other resilient or spring-like member which can be incorporated into, and provide a predetermined shaping of an upper portion of the flexible urinal-receptacle; wherein, in each case, the shaping member is thereby predisposed to expand an upper opening portion of the flexible urinal-receptacle to its normally-expanded state when, or as, a positionable panel is moved to a fully-opened position. Subsequently, as the panel is moved to a closed state, the receptacle-opening shaping member is urged into a contracted state to readily fit within a wall recess, e.g., within a depth less than 4 inches. Thus, advantageous expandable embodiments of the present invention can be provided, by the making of urinal-receptacles with flexible material, or material adapted for repeated expansion and contraction cycles, that are easily storable between: a reduced-depth profile within a standardized wall e.g., in compliance with building code requirements pertaining to minimum wall depths (or wall stud depths) such as typical walls less than 4 inches in depth; and, an expanded-depth (and/or width) profile, for example expandable by a factor of 2× or 3× (e.g., approximately 8-12 inches). And do so in a manner wherein a majority portion of an upward-facing opening of the urinal-receptacle extends exteriorly out from customary cabinetry or a wall or when the positionable panel is moved to an opened position.

In an alternative wall-mountable embodiment, a rigid, or semi-rigid urinal-receptacle is configured having a height less than the depth of a standard wall stud (e.g., less than four inches), and is equipped with suitable coupling or linkage to be pivotally positionable by a moving of an associated positionable panel, between: a reduced-profile state on its side within a wall recess; and an extended-profile state pivotally positioned approximately 90°, such that a majority portion of an upward-facing opening of the urinal-receptacle extends exteriorly out from the wall when, or as, the positionable panel is moved to an opened position. To prevent fluids from spilling out of the urinal-receptacle when rotated to its reduced-profile state within a wall, the urinal-receptacle is configurable with at least two gravity-fed liquid-conducting outlets located generally in a 90° orientation to one another, with each of the outlets channeled to, or connected with, a common waste liquid-conducting conduit, wherein: a first gravity-fed liquid-conducting outlet (adjacent to a bottom portion of the urinal-receptacle) is rotated to a lowest point beneath the upper opening of the receptacle during a use-cycle to conduct fluids to the common liquid-conducting conduit; and, a second gravity-fed liquid-conducting outlet (adjacent to a side portion of the urinal-receptacle) is rotated approximately 90° to a lowest point when the urinal-receptacle is stored in a reduced-profile state to conduct any residual, or receptacle self-cleaning fluids, to the common liquid-conducting conduit. Other approaches to preventing fluid spillage when the urinal-receptacle is rotated to its reduced-profile state within a wall are also possible and can be provided. For example, a lowest portion of the upper opening perimeter, when the urinal-receptacle is rotated and stored in the reduced-profile state, can be configured with a fluid-retaining lip or rim which is suitably sized and shaped to retain fluids in the urinal-receptacle until it is extended exteriorly out from the wall when, or as, the positionable panel is moved to an opened position.

Accordingly, a double space-saving benefit is achievable by optionally combining any of the aforementioned urinal-receptacles configured with mist-dispensing means positionable between an extended-height mist-dispensing state and a reduced-height (or reduced-profile) storing state, with any of the urinal-receptacles rotatable or contractible from an outwardly-extended state to a reduced-profile storing state within a wall.

Optionally, any of the above-mentioned urinal-receptacles may be made releasably attachable for easy removal, replacement, updating to a new or different style, servicing, additional cleaning as needed, and the like. For example, a urinal-receptacle may be configured to slidably fit and be retained within a urinal mounting frame, or supported by one or more support members, attachable to a normally interior-facing portion of a positionable panel. Optionally, a lower portion of a urinal receptacle may be supported by one or more support members attachable to an interior portion of customary cabinetry, or of a wall. Additionally, a urinal-receptacle may be configured for quick installation, having: at a lower end a downwardly extending and/or tapered waste-liquid outlet or coupler which is sized and shaped to slidably fit, preferably in a self-centering manner, within a receptively-shaped upward-facing coupler connected with an upper end of a waste-liquid conduit; and, one or more upper urinal-receptacle portions can be configured to provide support and a self-centering of the upper end of the receptacle; wherein, at least the upper end of the urinal-receptacle, and optionally the lower end, is supportable by the urinal mounting frame and/or one or more of the support members. When a urinal-receptacle of the present invention is so configured, the receptacle can be instantly removed, or virtually dropped into place for instant use.

Accordingly, the present invention provides various approaches to achieving significant, or substantial, reduced water-usage in urinals whether mounted in a customary fixed manner (e.g., to a wall) or as applied to the positionable-urinal embodiments described herein. While the present application is primarily directed to embodiments pertaining to positionable urinals each incorporating a number of advantageous elements or components, it is noted that some of its aspects previously described, and disclosed in descriptions to follow, may advantageously be applied to fixed urinals in one or more inventive ways, in which case any of such aspects can be included in one or more continuation applications deriving from, and/or relying on, the present application.

To facilitate easy usage of the urinal at night, or in a reduced-light setting or environment, the urinal can be equipped with controllable lighting means configured to direct light onto at least a portion of the upward-facing urinal-receptacle, or portion of the urinal, for example viewable to a user when the urinal-receptacle is not in a concealed state (e.g., during a use-cycle). The controllable lighting means are made controllable by suitable lighting control means, for example, by any one or more among a variety of commercially-available light switches or controllers, or by one or more suitable control means described elsewhere in this specification. The lighting control means may also be configured responsive to a movement of one or more positionable elements or components of the present invention, such that a movement of an element or component causes a switching, or a turning on, or a turning off, of a lighting means. For example, controllable lighting means can be controlled by an electrical switch configured to be switched to a power-on state or power-off state by a movement occurring between a positionable switch activating member and at least one positionable member, or portion, of the electrical switch. More specifically, the switch may be moved to a power-on condition by a first interaction occurring between the switch and the positionable switch activating member during, or at an end of, a positioning of the upward-facing urinal-receptacle to a revealed-for-use state; and, the switch may be moved to a power-off condition by a second interaction occurring between the switch and the switch activating member during, or before, a positioning of the upward-facing urinal-receptacle to a concealed state. Optionally any portion of a positionable urinal, or urinal-receptacle configured to receive said distributed misted spray volume, can be made partially, or entirely, of a transparent or translucent material, and may optionally also be equipped with controllable lighting means for example, comprising one or more (but not limited to) the following: lights, low-voltage lights, low-wattage lights, L.E.Ds, string of lights, shaped-tube lights (e.g., fluorescent, or neon, and the like), configured to direct light onto, or to provide a back-lighting onto, the transparent or translucent material. Optionally, a rear upward-extending opaque, translucent or transparent panel, or splash plate, located behind a urinal-receptacle alternatively or additionally may be equipped with controllable lighting means.

A urinal, or portion thereof, is configured attachable with an interior side portion of a positionable panel of a door, door-like member, drawer or drawer-like member pivotally mountable adjacent to, or configured slidably operable from, an opening of a wall or an opening of customary cabinetry of a room. For example, in the case of customary cabinetry, the urinal may be fitted or retro-fitted onto an interior portion of an existing door or drawer panel of customary cabinetry of a room prior, or subsequent to, the installation of the customary cabinetry. Alternatively, a urinal may be attached, or configured releasably attachable, to an interior portion of a door, door-like member, drawer, or drawer-like member, custom-made for installation onto customary cabinetry already installed in a room or onto customary cabinetry prior to its installation. Additionally or optionally, a side, or vertical surface area of customary cabinetry not having a door or a drawer may be modified to have an opening suitable for the mounting of a positionable panel. It is noted, that while the term 'customary cabinetry' may suggest to a reader enclosures constructed out of wood, that the term as used herein is not meant to imply such a limitation. For example, customary cabinetry of the present invention may be made with any one or more among a variety of materials, or processing of materials, in compliance with standard or typical building codes, such as: woods, metals, alloys, plastics, flexible material, silicon, glass, fiberglass, resin, fiber, particle, composites, pressed, veneers, laminated materials, laminates, coverings, coatings, painted, printed, laser printed, ink-jet printed, inlaid, CNC-shaped materials, carved, embossed, extruded, fabricated, formed, machined, routered, grinded, printed, stamped, cast, die-cut, glued, fastened, joined, and the like. It is noted that the term "customary cabinetry" also refers to finished cabinetry, or enclosures, of a type that are made to typically occupy, or install into, a room, or other walled area, and provide one or more common cabinet functionalities, and that are adaptable or configurable to: accommodate a urinal and mist-dispensing means of the present invention in a space-saving manner (e.g., having a positionable panel which extends outward into a room when in a closed or non-use state no further than the width of the panel); and, provide the very low water-usage and urinal self-cleaning distributed misted spray volume. For example, a door or drawer of a bathroom vanity may be configured to accommodate the very low water-usage urinal of the present invention.

In each case, a positionable panel is configured to operate between a closed position and an opened position in a door-like or drawer-like manner: to conceal the very low water-usage self-cleaning urinal within customary cabinetry, or a wall, behind the positionable panel when it is moved to a closed position; and, to extend a portion of the upward-facing opening of the urinal-receptacle exteriorly out from the customary cabinetry, or wall, when the positionable panel is moved to an opened position. Mist-dispensing means of the urinal are connected by suitable conduit and conduit-coupling (e.g., flexible conduit and/or coupling) with a controllable water supply which in turn is controllable by water supply control means, such as a valve, for turning on or off water as needed. Alternatively, a forward-facing portion of a urinal may be configured having the appearance of a positionable panel (or other appearance), or the urinal may be configured positionable on a horizontal positionable panel such that a forward-facing portion of the urinal is viewable, and any one or more of the aforementioned suitable control linkages, levers, couplings or transmission means (e.g., at a 1:1, or other ratio) are instead coupled with the urinal or a positionable member associated with the urinal.

Optionally, a normally interior-facing portion of a positionable panel, or interior location within customary cabinetry or a wall (e.g., concealable by a positionable panel), may be configured to dispense to a user, when the positionable panel is opened, one or more products associated with the using of a urinal, or a restroom (for example toilet and/or facial tissue, and the like). Or in instances where it may be advantageous to equip and/or modify very low water-usage urinals for use by females, a positionable panel (or normally interior-facing portion thereof), or interiorly-located portion of customary cabinetry, or a wall, may be configured to dispense a funnel-like product, or other urination-related product, made to be employed by women while standing, or while using a urinal. As such products do exist, and have had some acceptance to date, it is therefore quite feasible that a providing of the latter products, by suitable dispensing means mounted to: a positionable panel; an interior location within customary cabinetry, or a wall; or, from suitable dispensing means located adjacent, or nearby, one or more urinals, could provide substantial reductions in water-usage in restrooms that heretofore have solely been equipped with much higher water-usage toilets. It is further noted, that in many restroom facilities providing public access to users (e.g., nightclub, restaurant or bar restrooms), very poor hygienic conditions often exist, such as toilet seats that are not kept clean after one or more use-cycles, requiring a subsequent user to either perform the necessary cleaning, or to try to use the toilet in an uncomfortable straddling, standing or crouching position. Consequently, many women might be motivated, e.g., when using a toilet in a sitting position is not required (e.g., for urination only) to: contribute to a substantial reduction in water-usage; avoid having to straddle, stand or crouch over dirty toilets or in dirty toilet stalls; avoid having to clean toilet seats before using them; reduce the waste of toilet paper used to (or in an attempt to) clean toilet seats, or wasted toilet-seat covers; and, have a more hygienic alternative presented to them, made possible by a dispensing of the funnel-like product, or other urination-related product, made to be employed by women.

To provide the aforementioned enhanced space-saving aspects of the positionable urinal of the present invention, the urinal can be configured positionable between one or more larger expanded or extended-profile states and one or smaller reduced-profile states. For example, the mist-dispensing means of the urinal can be configured positionable with suitable positioning means, to provide: a moving of the mist-dispensing means from an expanded or extended mist-dispensing state (such as a position located higher than its corresponding positionable panel) to, or into, a reduced-profile storing state, while also providing during the mist-dispensing state, an operative alignment or any necessary positioning(s) of the mist-dispensing mean with the interior urinal-receptacle surface during the dispensing of the aforementioned distributed misted spray volume. The positioning means may be operatively coupled to the mist-dispensing means, or between the mist-dispensing means and a surface portion associated with, or adjacent to, the urinal, or an inside portion, member, frame or bracket of customary cabinetry, or of a wall. Wherein, in each case, a moving of the positionable panel from a closed state to an opened state correspondingly moves the mist-dispensing means from a reduced-profile storing state into a mist-dispensing state in operative alignment with the interior urinal-receptacle surface and providing the distributed misted spray volume; and, a returning of the positionable panel to a closed state correspondingly moves the mist-dispensing means to the reduced-profile storing state.

Mist-dispensing means can be configured positionable, in a manner including, but not limited to, one or more of the following movements: sliding, linear, pivoting, rotating, swiveling, swinging, arcing, leveraging, and the like. In the remainder of this paragraph examples of positionable mist-dispensing means are provided that are slidably, rotatably (or rotatably and slidably), and pivotally positionable, wherein in each of the examples, mist-dispensing means may comprise an elongated portion of a water supply member such as a tube, conduit or tamper-protective sheath (e.g., surrounding the tube or conduit) which is made, fabricated, formed or shaped having any among a variety of shapes. In each example, a positionable water supply member is located in close proximity to a urinal-receptacle opening and configured with suitable coupling and/or linkage means between the water supply member and a positionable panel (or associated member movable with the panel), and is thereby responsive to: a positioning of a slidably or pivotally positionable panel made by a user, or by powered mechanical actuating means, which causes a corresponding positioning of the member, and preferably does so between a reduced-profile storing state and an extended-profile state. It is noted that the positioning means of the present invention may further comprise any one or more among a variety of manually-positioned or powered return-means, configured with suitable coupling and/or linkage to a positionable panel (or other member associated and movable with the panel) to facilitate, assist or solely position the panel and mist-dispensing means from an extended-profile state to a reduced-profile storing state. In a slidably-positionable example, the water supply member is mounted slidably within an aperture, or inner diameter of a cylinder or sleeve, located in close proximity to a urinal-receptacle opening (e.g., to be slidable up and down), wherein, the aforementioned positioning of the positionable panel causes a corresponding slidable positioning e.g., a vertical positioning of the member between an extended-profile state and a reduced-profile storing state. In a rotatably-positionable example, the water supply member is configured rotatably (or rotatably and slidably) positionable within a similar aperture, or inner diameter arrangement, located in close proximity to a urinal-receptacle opening, wherein, a positioning of a positionable panel causes a corresponding rotatable positioning e.g., a rotatable positioning of the member between an extended-profile state and a reduced-profile storing state. In a pivotally-positionable example, the water supply member is retained within, and configured pivotally positionable around the longitudinal axis of, a pivot member mounted or attached transversely along an elongated portion of the member, wherein, a positioning of a positionable panel causes a corresponding pivoting positioning of the member e.g., between a vertical extended-profile state and a horizontal reduced-profile storing state. For example, the water supply member may be equipped with an upper end having an inverted L-shape or hook-shape (ending with one or more mounted misters), wherein a returning of the member to a horizontal reduced-profile state from a vertical state entails pivoting the L-shape or hook-shape member portion into a position neatly adjacent to, or in close proximity with, an angled or rounded portion of the urinal-receptacle (or urinal).

Optionally, positionable mist-dispensing means can be mechanically associated or coupled with a positionable valve controller of a valve, such that a moving of one, by manual or powered mechanical actuating means, causes the simultaneous moving of the other. For example, wherein a positionable valve controller is moved to open, or moved to a valve opened state, in response to a positioning of the mist-dispensing means from a reduced-profile storing state to a mist-dispensing state; and, the positionable valve controller is moved to close, or moved to a valve closed state, in response to a positioning of the mist-dispensing means from the mist-dispensing state to the reduced-profile storing state. To illustrate an example: a positionable valve controller of a valve is configured mountable adjacent to and attachable with mist-dispensing means, such that a pivot or rotational axis of the valve controller is aligned with a pivot or rotational axis of a mist-dispensing means element or component e.g., a water supply tube of the mist-dispensing means leading to one or more misters, such that a pivoting or rotational positioning of one (i.e., the valve controller or the tube) causes a corresponding positioning of the other. In another example, a positionable valve controller is separably mountable from, and mechanically coupled to the mist-dispensing means with suitable control linkage, coupling or transmission means (at a predetermined ratio e.g., 1:1, or other ratio), such that a positioning of one respectively causes a positioning of the other. It is noted that a positionable valve controller of a valve may alternatively be a valve which is activated by a valve switch or switching means, having one or more positionable switches, levers or buttons configured to be moved by suitable linkage, coupling or transmission means, between a valve closed state and a valve opened state in response to a positioning of either mist-dispensing means or a positionable panel. The present invention may also be configured such that positionings other than a pivoting or a rotational movement may alternatively and advantageously be employed, and through suitable coupling and/or transmission means translate a first movement of one type into a second movement of a different type to provide or facilitate positioning of one or more of positionable members or components of the present invention. For example a positioning may include, but is not limited to, any one or more of the following movements: sliding, linear, pivoting, rotating, swiveling, arced, leveraged, and the like.

To further provide or facilitate urinal positioning, or a positioning of one or more of the urinal-related positionable components such as the mist-dispensing means, panels, or valve controllers, and the like (or linkage, coupling or transmission means associated therewith), the present invention is configurable to provide controllable, powered mechanical actuating means. For example, actuating means and/or associated linkage, coupling or transmission means, may be selected from (but are not limited to) one or more of the following: electro-mechanical actuators; electro-magnetic actuators; linear-actuators; hydraulic actuators; hydraulic actuators incorporating pistons, valve-pistons or bellows; hydraulic actuators having a urinal positioning phase preceding a water dispensing phase; a standpipe configurable in, or between, a vertical or horizontal orientation and equipped to provide one or more pneumatic pressurized-air outlets and optionally provide one or more hydraulic pressurized-water outlets; pneumatic actuators; pneumatic piston or bellows incorporating actuators; step-on bladder; servo or motor driven transmission means, rack and pinion arrangements; cams and associated cam-operated members; bell cranks; crankshafts; control arms; connecting rods; push rods; control linkage, cabling, pulleys, belts, sprockets; chains; telescopically adjustable members; telescoping scissor-action apparatus; pushrods or lead-screws; levers; return springs; return weights; computer or microprocessor controllable actuators, motors, servos or lead-screws, screw jacks in thrust bearings; and the like.

To control the powered mechanical actuating means the present invention is configurable to provide one or more control means, for example selectable from one or more of the following: manually operated switches or levers; electro-mechanical switches or levers; foot-operated switches or levers; step-on plates; step-on members configured for actuating a piston, valve-piston or bladder; proximity-sensing switches or sensors; motion-sensing switches or sensors; infrared or temperature sensing switches or sensors; light-sensing switches or sensors; sound-sensing switches or sensors; sensors, switches or valves configured to be operatively responsive to a voice command or programmable voice command; computer or microprocessor controllable switches or valves; cash, credit, debit or magnetic-strip card pay-per-use actuated apparatus, switches, locks or valves; switches, sensors or valves equipped to be operatively responsive to one or more signals, passwords, user names, activation codes or payments transmittable from a handheld wireless device, cell phone or remote control device; predetermined or programmable timer controlled switches, sensors, locks or valves; fluid-controlling valves; air-controlling valves; limit switches; stops, and the like. It is noted that any of the control means described in this specification may optionally further include a user-controllable, password code programmable, timer-controllable (or programmable) switch or locking means, suitably configured to deactivate, or activate the control means.

In reference to the employment of a piston-valve as a powered mechanical actuating means or a control means (or both), in structure, a piston-valve equipped cylinder may be provided configured with a piston slidably operable in the cylinder in an air-tight and/or liquid-tight manner (or both), wherein an end of the piston facing an open end of the cylinder is equipped for coupling with control linkage for example, a connecting rod, and opposite end of the piston facing a closed or sealable end of the cylinder is made hydraulically and/or pneumatically positionable by controllable water (liquid) pressure, and/or controllable air (gas) pressure conveyable through one or more inlets located near, proximate or at the closed end of the cylinder. For example, the piston when so configured, is in a first positioning state while in a position nearest to the inlet, and is in a second positioning state when it is in a position furthest from the inlet. The cylinder is further equipped with one or more liquid or gas outlets each locatable at a predetermined spacing from the inlet and the outward-facing end of the piston when the piston is in the first state, such that a predetermined degree of movement of the piston and its associated control linkage may first occur and be applied as a powered mechanical actuating means to a first type of positioning; and subsequently, as the piston travels past an outlet, either pressurized gas or liquid can be employed by pneumatically or hydraulically powered mechanical actuating means as a second type of positioning, and so on depending on the number of outlets. Alternatively, a liquid outlet of the cylinder may be coupled with a suitable conduit leading to very low water-usage mist-dispensing means, and thereby be employable as a delayed pressurized water supply source, wherein a first positioning occurs by an exploiting of the piston movement (e.g., as previously described), for example, to move a urinal a predetermined amount before the mist-dispensing means receive pressurized water. It is noted that a standpipe, whether vertically or horizontally orientated (or in between a vertical or horizontal orientation) may be modified to incorporate a piston-valve. Additionally, when the cylinder, or standpipe variant of the cylinder, is mounted in a horizontal orientation, one or more outlets located at, or along, an upper portion of the cylinder may be employed as 'timed' or sequentially delayed gas outlets, and one or more outlets located at, or along, a lower portion of the cylinder may be employed as 'timed' or delayed water (or liquid) outlets. Preferably the cylinder or standpipe variants are made configurable with, or made responsive to, return means (such as a return-spring, or a coupling made with a return weight) such that the piston is returned to a first positioning state as water and/or air pressure is reduced, or is brought below a predetermined threshold. Thus, various ways of advantageously incorporating a variable-timing, dual-function or multi-function piston-valve equipped cylinder of the present invention, as a powered mechanical actuating means and/or pressurized water supply means is provided and may be employed.

In a simpler approach, a bellows, or other expandable and contractible receptacle, may be employed within a cylinder, enclosure or sleeve having an outward-facing end, facing an open end of the cylinder, enclosure or sleeve, equipped for coupling with control linkage, and an opposite end located adjacent, near or at, an end of the cylinder, enclosure or sleeve configured with one or more gas or liquid inlets each coupled to a conduit providing a supply of pressurized water or air. In operation, the bellows or receptacle is hydraulically and/or pneumatically positionable by controllable water (liquid) pressure, and/or controllable air (gas) pressure conveyable through the one or more inlets. For example, a bellows when so configured, is in a contracted first positioning state while its outward-facing end within the cylinder, enclosure or sleeve, is in a position nearest to the inlet(s) e.g., in response to a lower or zero pressurized condition, and is in an expanded second positioning state when it is in a position furthest from the inlet e.g., in response to a higher pressurized condition. Thus, the bellows (or receptacle) when so configured, are employable as powered mechanical actuating means equipped to provide a predetermined degree of movement to associated control linkage which in turn are configured any of the aforementioned types of positionings.

The present invention therefore furnishes positioning means that provide and/or maintain a co-alignment of very low water-usage mist-dispensing means and an interior surface of a urinal receptacle, which provides the efficient, water-conserving distributed misted spray volume.

While various means have been described to control, provide or facilitate positioning of different positionable members or components of the present invention, it is noted that any one or more of the same or similar means may alternatively be employed for collectively positioning a plurality of the positionable members. For example, very low water-usage mist-dispensing means may be mounted in a fixed position on, or with respect to, a urinal or urinal-receptacle so as to be positioned in concert collectively with the urinal or urinal-receptacle in a manner providing the aforementioned distributed misted spray volume. Alternatively, a self-cleaning urinal attachable to a positionable panel, and a positionable very low water-usage mist-dispensing means may be configured collectively positionable by: positioning means operatively coupled with the mist-dispensing means as previously described, and additional positioning means operatively coupled at a first end to a portion of the positionable panel (or other structural member associated and movable with the panel); and the positioning means operatively coupled at a second end to a member generally located adjacent, or interiorly behind, an opening of a wall or an opening of customary cabinetry of a room, wherein a moving of the positionable panel between a closed state and an opened state (e.g., manually, or by powered mechanical actuating means) correspondingly positions the self-cleaning urinal and said very low water-usage mist-dispensing means between a concealed state and/or reduced-profile state and a revealed-for-use state.

BRIEF DESCRIPTION OF THE DRAWINGS

FIGS. 5A through 7B are two-dimensional side view depictions of customary cabinetry and examples of positionable drawer and door arrangements, with each opened drawer or door showing a positionable urinal and mist-dispensing means, wherein the latter is configured positionable in concert with the urinal at a fixed height, or positionable with the urinal and having an independently variable height (positionable between reduced-profile and extended-profile states).

In FIG. 5A customary cabinetry is depicted having a full cabinet-height drawer or door.

In FIG. 5B a full cabinet-height drawer is depicted slidably positionable with a urinal receptacle and mist-dispensing means.

In FIG. 5C a full cabinet-height door is depicted pivotally positionable (about a vertically hinged axis) with a urinal receptacle and mist-dispensing means.

In FIGS. 5D and 5E a full cabinet-height door is depicted pivotally positionable (about a lower horizontally hinged axis) with a urinal receptacle and variable-height mist-dispensing means, and is shown in an extended-for-use state in FIG. 5D and a closed, concealed/storing state in FIG. 5E.

In FIG. 6A customary cabinetry is depicted having partial cabinet-height drawers or doors with the top drawer or door being shortest in height.

In FIG. 6B a partial cabinet-height top drawer is depicted slidably positionable with a urinal receptacle and variable-height mist-dispensing means.

In FIG. 6C a partial cabinet-height top drawer is depicted pivotally positionable (about a vertically hinged axis) with a urinal receptacle and variable-height mist-dispensing means.

In FIG. 6D a urinal receptacle and variable-height mist-dispensing means is depicted slidably positionable supported on a horizontal planar member which when slid outward pivotally positions a top door-like panel about a horizontally hinged axis between vertical (closed) and horizontal (outwardly extended) positions.

In FIG. 6E (cut-away side view) a partial cabinet-height middle drawer or door is depicted with a urinal receptacle and variable-height mist-dispensing means slidably or pivotally positionable from a concealed, zero-footprint state within customary cabinetry to an extended-for-use position as shown in FIGS. 6F and 6G respectively, and in FIG. 6E a plumbing coupler is shown configurable within customary plumbing and equipped to receive a flexible waste liquid line (shown in a dashed line).

In FIG. 6H a urinal receptacle and variable-height mist-dispensing means is depicted slidably positionable supported on a horizontal planar member which when slid outward pivotally positions a middle door-like panel about a horizontally hinged axis between vertical (closed) and horizontal (outwardly extended) positions.

In FIGS. 7A and 7B a dashed line rectangle depicts an outline of a non-standard panel opening which can be made in an end of customary cabinetry including cabinetry having one or more full-height or partial-height cabinet drawers or doors wherein a urinal and very low water-usage mist-dispensing means can be configured slidably or pivotally positionable between a concealed, zero-footprint state and an extended-for-use state.

FIGS. 10C and 10D further illustrate the incorporation of urinal receptacle lighting means.

FIG. 11C depicts a three-dimensional rear view of the frame-mountable urinal and positioning path of very low water-usage mist-dispensing means (indicated by a dashed, double arrow-headed arc), and a mounting of a flange of the frame to a wall stud.

FIGS. 20A through 24C illustrate positionable alignment arrangements, between mist-dispensing means (fixed or positionable) and respective urinal receptacle (fixed or positionable), wherein the positionable alignment facilitates a dispensing of a distributed misted spray volume within the urinal receptacle.

FIGS. 20A and 20B are three-dimensional front views of mist-dispensing means vertically positionable, next to a urinal receptacle, between reduced-profile and extended-profile states (FIGS. 20A and 20B respectively), wherein alignment of the extended-profile state facilitates a dispensing of a distributed misted spray volume within the urinal receptacle.

FIG. 24C is a three-dimensional cut-away side view of a urinal receptacle and independently positionable mist-dispensing means configured pivotally positionable between reduced-profile and extended-profile states (reduced-profile not shown), wherein the extended-profile state provides alignment with the urinal receptacle alignment which facilitates a dispensing of a distributed misted spray volume within the urinal receptacle.

In FIGS. 25A, 25B and 25C the mist-dispensing means are configured pivotally positionable in response to drawer positioning. In FIGS. 26A, 26A, 26B mist-dispensing means the mist-dispensing means are configured pivotally positionable in response to drawer positioning.

In FIG. 27A a rack and pinion arrangement is shown wherein a pinion gear attached to the end of a driveshaft, driven by a reversible motor, engages a rack gear attached to the positionable drawer.

In FIG. 27B a lead screw and screw follower arrangement is shown, wherein a lead screw end attached to the end of a driveshaft driven by a reversible motor linearly positions a screw follower attached to the positionable drawer.

In FIG. 27C a hinged mechanical arm arrangement is shown, wherein a first end of a mechanical arm is attached to the end of a driveshaft driven by a reversible motor, and a second end of the arm is attached to a side of the positionable drawer to provide linear positioning of the drawer. FIG. 27C also illustrates a valve configured positionable in response to In FIG. 27D a hydraulic or pneumatic (fluid) actuator-cylinder arrangement is shown, wherein a connecting rod is connected at a first end to an outer end of a piston, and a second end of the rod is pivotally attached to a pivot arm which in response to a positioning of the piston, by increased or decreased pressure in the actuator-cylinder, linearly positions the positionable drawer.

In FIG. 27E a hydraulic actuator-cylinder and valve arrangement is shown, wherein a connecting rod and pivot arm are configured responsive to a piston positioning as previously described in reference to FIG. 27D. The hydraulic actuator-cylinder and valve is additionally configured with one or more water-outlets to provide timed delayed hydraulic actuation, which in FIG. 27E provides pressurized water to the mist-dispensing means after the drawer is positioned by the actuator-cylinder piston to an extended-for-use state.

In FIG. 27F a pulley and drive-belt arrangement is depicted, wherein a first pulley attached to the end of a driveshaft, driven by a reversible motor, positions a belt, which in turn positions a belt connector attached to the positionable drawer. Alternatively, FIG. 27F is described having sprockets instead of pulleys, and a chain instead of a belt.

DETAILED DESCRIPTION OF THE PREFERRED EMBODIMENTS

Figure 1A:
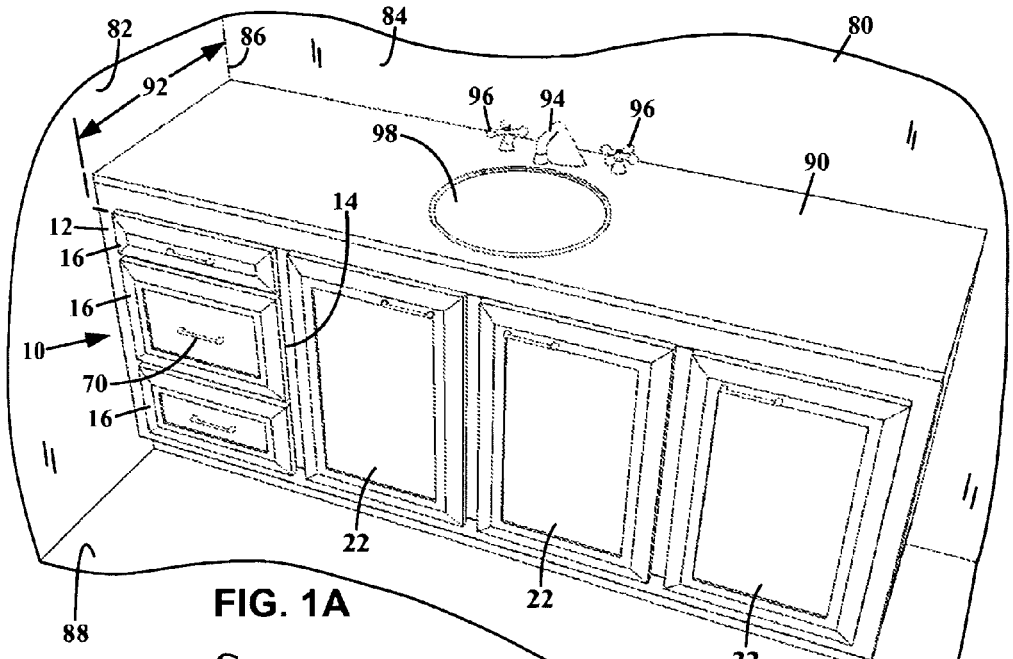
FIGS. 1A and 1B are three-dimensional views of customary cabinetry within a portion of a room, with the cabinetry having a partial cabinet-height drawer configured with a urinal and variable-height, very low water-usage mist-dispensing means, slidably positionable between a concealed, zero-footprint state and an extended-for-use state.

FIGS. 1A through 27F, discussed below, and the various embodiments used to describe the principles of the present invention in this patent document are by way of illustration only and do not limit the scope of the invention. Those skilled in the art will understand that the principles of the present invention may be implemented in many different suitably arranged urinals.

Reference numerals employed in the detail description to follow may be repeated in the drawings to assist, through a repeating, in a better understanding of the structure and/or operation of the present invention.

Figure 1B:
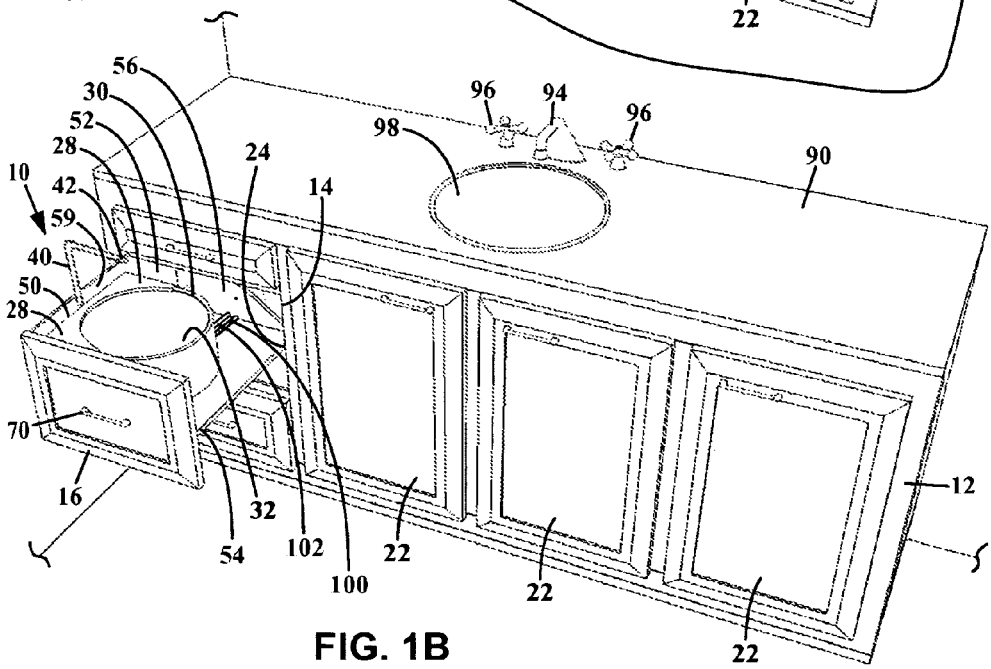

In reference to FIGS. 1A and 1B, a three-dimensional depiction of customary cabinetry 12, such as a bathroom vanity, or other enclosure typical of the type installed in, or installable into, a room, is shown located at a room corner 86 and adjacent to a side wall 82 and a rear wall 84 and occupies a given three-dimensional 'foot-print.' For example, the customary cabinetry extends outwardly onto floor 88 and into an interior portion of the room, and extends upwardly from the floor to a cabinet top 90 having a customary cabinet height, width and cabinet depth 92. Optionally, the cabinet top 90 may also be equipped with a sink 98, faucet 94 and one or more faucet valves 96, each connected in a typical plumbing manner. For the purposes of illustration an forward-facing side of the cabinetry is shown having a plurality of partial cabinet-height positionable panels 16 and full cabinet-height positionable panels 22 (of drawers and/or doors), but it is noted that the customary cabinetry may be equipped with various other arrangements of one or more doors or drawers, or both. Embodiments of the present invention pertaining to positionable panels of customary cabinetry include configuring a positionable panel as a front panel of a slidably positionable drawer, or alternatively configuring a panel to operate as a door equipped with one or more hinges or other pivot means having either a vertical or horizontal pivot axis. To facilitate a manual positioning of either panel type, an exterior portion of a panel may be equipped with a customary grip-means, such as a commercially available recessed or outwardly extending handle 70. The urinal of the present invention, hereinafter referred to simply as "urinal," or "urinal 10," is configured relatively alignable with very low water-usage mist-dispensing means. The urinal, or a urinal portion, is made attachable with a normally-concealed surface, or interior-facing portion of a positionable panel (or structural member associated and made positionable with the panel). For example, in FIG. 1B urinal 10 is shown mounted adjacent, proximate or close to, an interior-facing surface of partial cabinet-height positionable panel 16 and is equipped with positionable mist-dispensing means 40 e.g., comprising one or more misters 42, mist nozzles, sprinkler emitters or mister-like elements. While urinal 10 is depicted being mounted adjacent to the interior-facing surface of partial cabinet-height positionable panel 16 by suitable mounting means 50, it is noted that the urinal, or a portion thereof, can alternatively be mounted on top of a drawer bottom 54, or to a drawer rear wall 56, or to a drawer side wall 59. Urinal 10 may also include a urinal top 28 adjacent to a perimeter portion, or completely surrounding the perimeter, of the urinal receptacle 30 (and urinal receptacle surface 32). Urinal 10 and mounting means 50 are configured for a mounting of the urinal in a fixed manner or in a releasably attachable manner. The urinal mist-dispensing means 40 are connected with a controllable, pressurized supply of water, such as water line 102, by suitable conduit and conduit connecting means, including but not limited to, one or more of the following: rigid tubes or pipes, flexible tubes or hoses, rigid or flexible couplings, quick-couplers or fasteners; couplings having a swiveling joint (e.g., like a typical faucet swivel joint), plumbing components, clamps, glued joints, threaded joints, and the like. The urinal receptacle 30 is equipped with one or more liquid-conducting outlets connected with suitable conduit and conduit connecting means to conduct liquid via a waste-liquid line 100 to a pipe, sink pipe, or coupler of a pipe or sink pipe configured to receive the conduit in a water-tight manner, for example leading to a sewer line, a waste-liquid outlet or a waste-liquid receptacle. Preferably the outlet end of the conduit is located or installed at a lowest point in the conduit path to facilitate a siphoning of waste liquids from the one or more liquid-conducting outlets. To accommodate the employment of, and a moving of, a partial cabinet-height drawer panel 16 (FIG. 1B) between a closed and an opened position, mist-dispensing means 40 are configured with positioning means for being positioned between a reduced-profile state and an extended-profile state (the latter state shown in FIG. 1B). Prior to, or during, a moving of panel 16 to a closed position (shown in FIG. 1A) the mist-dispensing means is positioned to a reduced-profile state providing an overall reduction in the height of the urinal, which allows concealment of the urinal within customary cabinetry 12.

In operation, as partial cabinet-height positionable panel 16 is slidably moved manually, or by powered mechanical actuating means, from the closed state depicted in FIG. 1A to the extended-for-use state depicted in FIG. 1B, a corresponding positioning of mist-dispensing means 40 from a reduced-profile state to an extended-profile state also occurs, through suitable linkage and/or coupling with positioning means (e.g., any one or more among the positioning means described in this specification). As the positionable panel is slidably moved back to a normally-closed state, the positioning means correspondingly positions the mist-dispensing means to a reduced-profile state at a height less than the height of the opening (14) in which the drawer operates. Accordingly, in the embodiments of the invention having a positionable urinal relatively alignable with the mist-dispensing means that are configured positionable between reduced-profile and extended-profile states, a double space-saving aspect is provided. For example, a urinal 10 made extendable both outwardly in depth e.g., from a zero-footprint concealed state (stored state) and upwardly in height, to provide a mist-dispensing means extended-profile state, is also equipped (following a use-cycle) to subsequently conform to its previous reduced depth and height e.g., in a zero-footprint manner (taking no additional space within a room than that already occupied by customary cabinetry).

Returning to the operational description of the embodiment shown in FIGS. 1A and 1B, when urinal 10 is slidably positioned to an extended-for-use state, on suitable or conventional slidable-drawer positioning means 24, mist-dispensing means 40, configured with positioning means (e.g., as described in detailed descriptions to follow) are correspondingly positioned to an extended-profile state, such that one or more misters 42 of the mist-dispensing means are brought into an operative alignment with urinal receptacle surface 32 of urinal receptacle 30. Relative alignment between the mist-dispensing means 40 and the urinal receptacle surface 32 enables a distributed misted spray volume of the present invention, when emitted, to condition urinal-receptacle surface 32 in a manner facilitating removal of waste liquid on, and a self-cleaning of, the urinal receptacle surface in a very low water-usage manner e.g., saving water 90% or more compared with standard one-gallon per flush (1 gpf) low water-usage urinals.

Figure 2A:
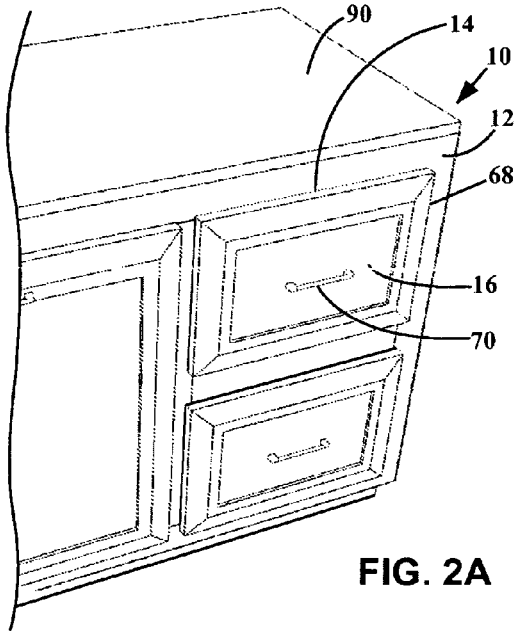
FIGS. 2A and 2B are three-dimensional views of customary cabinetry within a portion of a room, with the cabinetry having a partial cabinet-height door configured with a urinal and variable-height, very low water-usage mist-dispensing means, pivotally positionable about a hinge, between a concealed, zero-footprint state and an extended-for-use state.
Figure 2B:
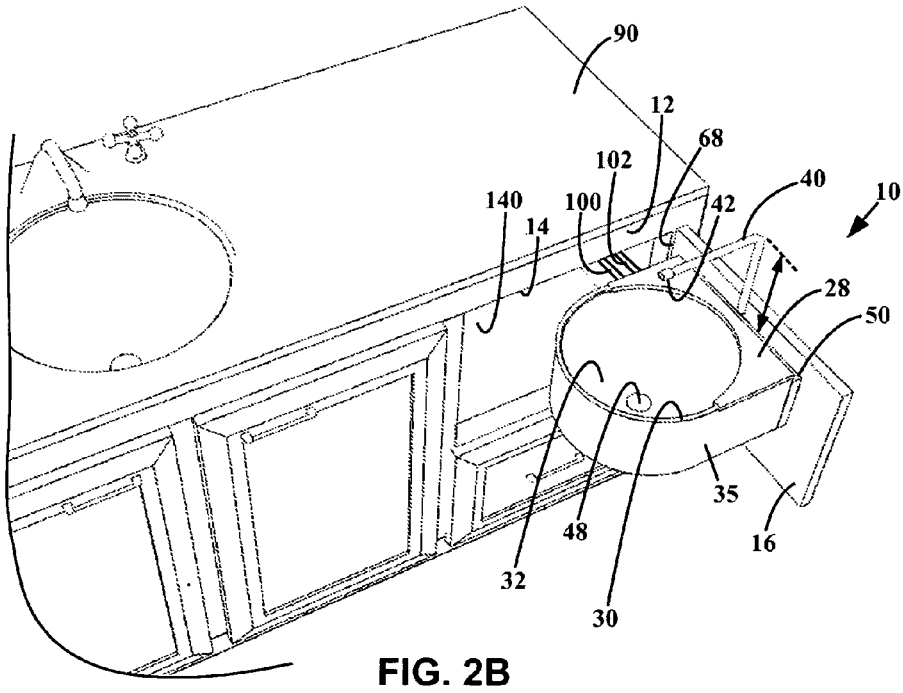
Figure 3A:
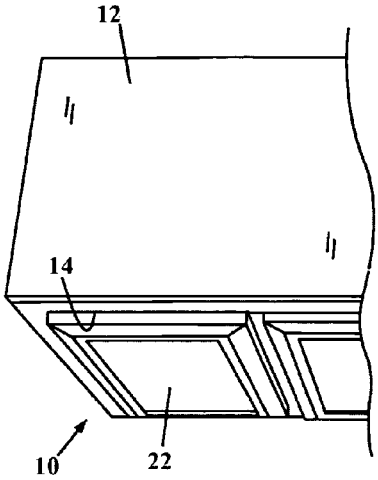
FIGS. 3A and 3B are three-dimensional views of a portion of customary cabinetry having a full cabinet-height drawer configured with a urinal and very low water-usage mist-dispensing means, slidably positionable in concert with the urinal between a concealed, zero-footprint state and an extended-for-use state.
Figure 4A:
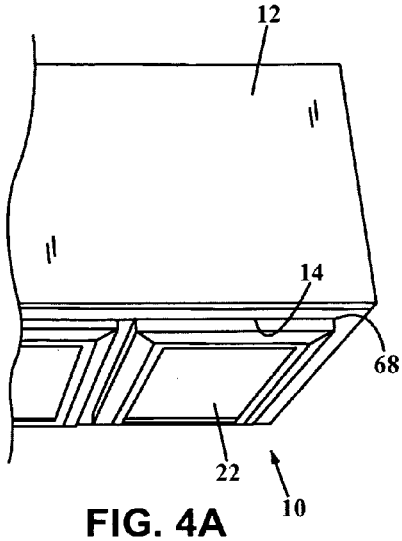
FIGS. 4A and 4B are three-dimensional views of a portion of customary cabinetry having a full cabinet-height drawer configured with a urinal and very low water-usage mist-dispensing means, pivotally positionable about a hinge, in concert with the urinal between a concealed, zero-footprint state and an extended-for-use state.
Figure 3B:
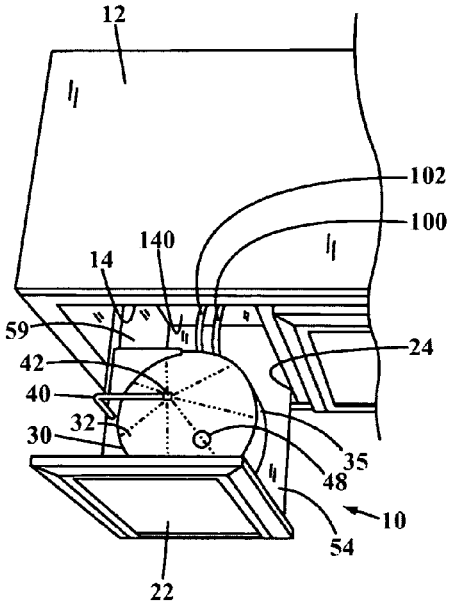
Figure 4B:
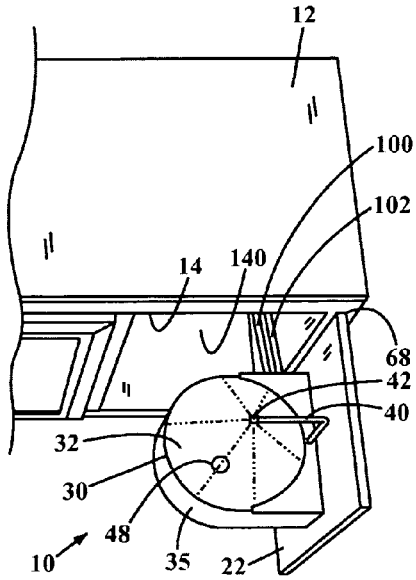

In reference to the embodiment illustrated in FIGS. 2A and 2B, customary cabinetry 12 is shown having a partial cabinet-height positionable panel 16, pivotally mounted adjacent to a customary cabinet opening 14 by one or more hinges 68 (or other suitable pivot means) to operate in a door-like manner, to position urinal 10 into and out from an interior volume 140 of the cabinetry. In FIG. 2A partial cabinet-height positionable panel 16 is shown in a closed state. In FIG. 2B the panel is shown in an opened state, with a double arrow-headed line indicating a span of vertical positioning or travel of mist-dispensing means 40 and one or more misters 42, and a urinal rear portion is configured mountable to the panel by suitable mounting means 50 (alternatively a urinal side 35 can be configured mountable to the panel). The mist-dispensing means 40 are configured positionable, e.g., by positioning means described in this specification, between a concealed, reduced-profile state when the door is pivotally moved to a normally-closed state as depicted in FIG. 2A, and, an extended-profile state when the door is pivotally moved to an opened state as shown in FIG. 2B. Accordingly, when urinal 10 is positioned to an extended-for-use state, a corresponding positioning of mist-dispensing means 40 to an extended-profile state also occurs, wherein one or more misters 42 (or one or more mister-like elements) of the mist-dispensing means are brought into an operative alignment with a liquid-capturing surface of urinal receptacle 30 providing a distributed misted spray volume which facilitates a repelling of waste liquid on, and provides a self-cleaning of, the urinal-receptacle surface 32 in a very low water usage manner. A water line 102 provides a controllable, pressurized supply of water to mist-dispensing means 40. A waste-liquid line 100 having an upper end attached to urinal drain 48 conducts waste liquid to a suitable waste-liquid pipe, conduit, drain pipe sewer pipe, receptacle, and the like. The water line may or waste-liquid line may be comprised of, but limited to, any one or more among the following: rigid tubes or pipes, flexible tubes, flexible couplers, swivel couplers, standard plumbing fittings, couplings, components, adhesives, fasteners, attaching means, and the like.

In FIGS. 3A and 3B, and 4A and 4B, full cabinet-height positionable panels 22 are depicted which are configured similarly to the partial cabinet-height slidable positionable panels 16 of FIGS. 1A and 1B and the pivotal, positionable panels 16 of 2A and 2B respectively, and are equipped with the previously described water line 102 and waste-liquid line 100. In the embodiments incorporating a full cabinet-height positionable panel, mist-dispensing means 40 may be configured positionable, for example, when the top of the urinal is mounted or attached close to the top of the interior-facing surface of panel 22, or may be configured in a fixed extended-profile state e.g., when the urinal is mounted lower on panel 22. When configured in a fixed manner, mist-dispensing means 40 are slidably positionable (FIGS. 3A and 3B) or pivotally positionable (FIGS. 4A and 4B) in concert with a liquid-capturing surface of urinal receptacle 30. When configured in a positionable manner, mist-dispensing means 40 are slidably or pivotally positionable into an operative alignment with a urinal receptacle surface 32 of urinal receptacle 30. In either case, the fixed or positionable mist-dispensing means provide the aforementioned distributed misted spray volume (depicted in dashed lines in FIGS. 3B and 4B) and its liquid-repelling, water-saving and urinal self-cleaning advantages.

Accordingly, various low-profile doors or drawers are configurable by the present invention to provide a double space-saving feature. As shown in FIGS. 1A and 1B, and FIGS. 2A and 2B, when the positionable panel is moved from an opened to a closed state, a first space-saving aspect occurs when the extended-profile state of the mist-dispensing means is positioned to a reduced-profile state, effectively reducing the height of the urinal 10; and a second space-saving aspect occurs when the urinal is moved to a normally-concealed state within customary cabinetry 12, whereby its previous extended-for-use depth is effectively reduced to an extent (e.g., to depth 92 of FIG. 1A) occupying no more space in a room than that taken by the room's customary cabinetry. As will be seen in reference to subsequent drawing figures, a similar double space-saving feature is also provided by embodiments of the present invention adaptable to door or drawer panels pivotally or slidably mountable on a wall.

Figures 5A, 5B, 5C, 5D, 5E, 6A, 6B, 6C, 6D, 6E, 6F, 6G, 6H, 7A, 7B:
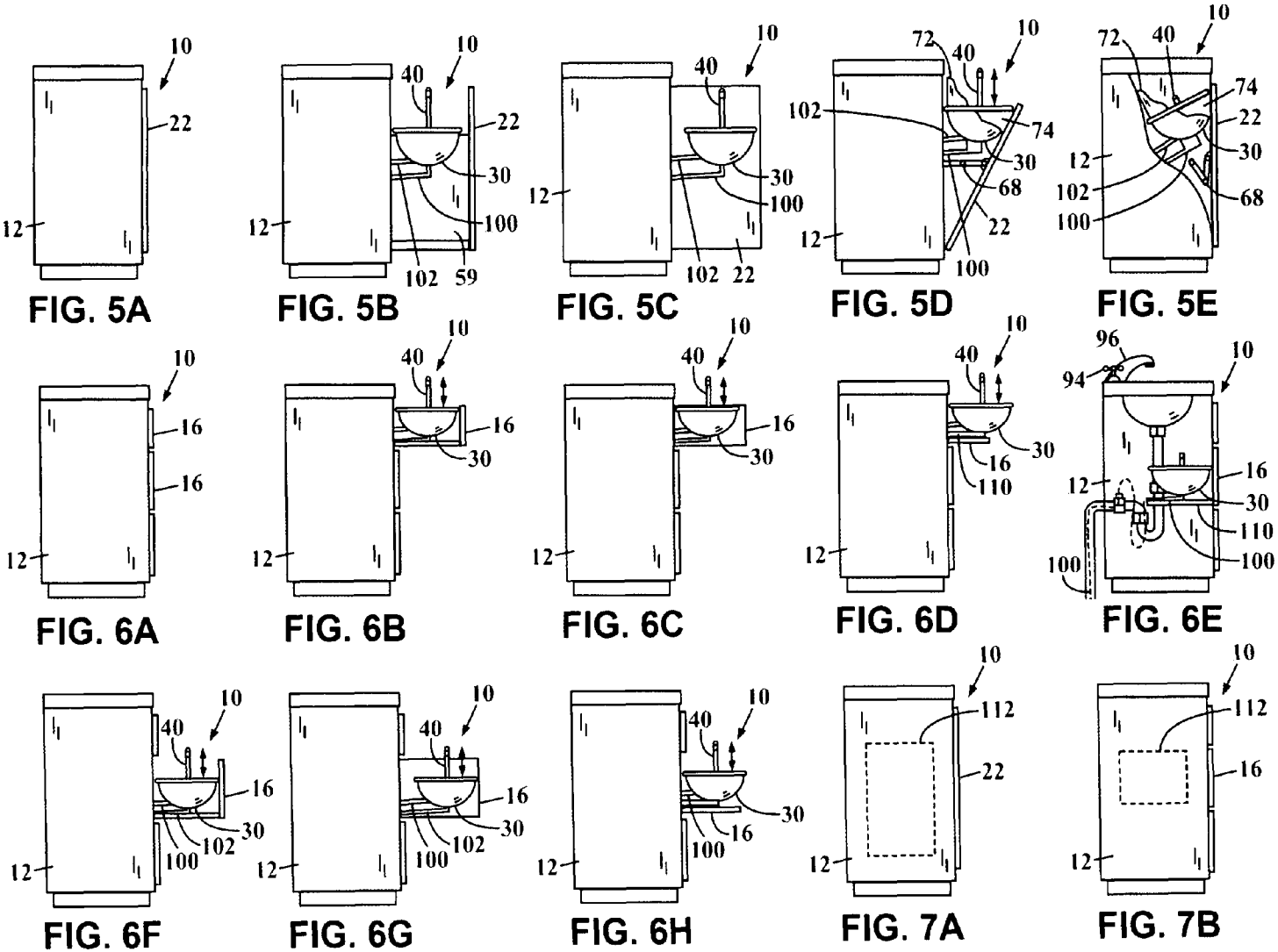

For the purposes of illustration, and not to be construed as a limiting of the scope of the invention, several profile or side view examples of partial cabinet-height and full cabinet-height doors and drawers, slidably or pivotally mounted on customary cabinetry 12, are provided in FIGS. 5A through 5E, 6A through 6H, and 7A and 7B. Wherein in FIGS. 5A through 5E full cabinet-height drawers and doors (22) are depicted; in FIGS. 6A through 6H partial cabinet-height drawers and doors (16) are depicted; and, in FIGS. 7A and 7B non-standard panel openings 112 are depicted (in dashed lines) formed in a side of customary cabinetry 12 such as cabinetry having one or more standard full cabinet-height drawers and/or doors (FIG. 7A), or having one or more partial cabinet-height drawers and/or doors (FIG. 7B). Urinal 10 and mist-dispensing means 40 configured positionable with slidable positioning means 24 are depicted in FIGS. 5B, 6B, 6D, 6F and 6H. Urinal 10 and mist-dispensing means 40 configured positionable with pivotable positioning means (such as one or more hinges 68, or other suitable pivot means) are depicted in FIGS. 5C, 5D, 5E, 6C, and 6G. Mist-dispensing means 40 are provided pressurized water by a water line 102, and the urinal receptacle 30 is equipped with one or more liquid-conducting outlets (not shown) connected with a waste-liquid line 100.

Referring to FIGS. 5A through 5E, in FIG. 5A a full cabinet-height positionable panel 22 (referred hereafter in the descriptions of FIGS. 5B through 5E as "panel 22") is shown in FIG. 5A in a normally-closed position, occupying no more space within the room that the cabinet is installed in (or installable in) than would be occupied by a typical closed door or drawer of customary cabinetry. In FIG. 5B panel 22 is configured to be slidably operable in a drawer-like manner e.g., by suitable slidable positioning means 24 and is shown in an opened, extended-for-use position, with the urinal (or a portion of the urinal or urinal receptacle) mounted or releasably attached to an interior-facing surface of a drawer side wall 59 (alternatively the mounting can be on one or more other suitable surface portions of panel 22). In FIG. 5C panel 22 is configured with one or more hinge 68 to be pivotably operable in a door-like manner and is shown in an opened, extended-for-use position, with the urinal (or a portion of the urinal or urinal receptacle) mounted or releasably attached to an interior-facing surface of panel 22 or may be mounted to another suitable surface portion(s) of panel 22. While panel 22 of FIG. 5C is depicted generally in a 90° orientation it is noted that any of the embodiments incorporating a pivotable door may be configured to exceed a pivot range of 90° (e.g., up to 180° or more) when it is advantageous to do so. In FIGS. 5B and 5C mist-dispensing means 40 may be configured at a fixed height such that an upper end of the dispensing means is lower in height than an upper end of the cabinet opening in which the urinal is moved into and out from. Alternatively, mist-dispensing means 40 may be configured positionable between a reduced-profile state and an extended-profile state. In the latter case, it is noted that the urinal receptacle 30 may alternatively be located higher than shown in FIGS. 5B and 5C, e.g., wherein an upper opening perimeter of the urinal receptacle is located no higher than the top of panel 22 (and whereby storage space within the customary cabinetry 12 below the urinal may optimally be utilized). In FIGS. 5D and 5E panel 22 is configured with one or more hinge 68 (or other suitable pivot means) to be pivotably operable in a door-like manner which pivots along a horizontal axis located at or near the lower end of panel 22 (in FIG. 5E an end of the customary cabinetry 12 is shown in partial cut-away view to show the urinal an associated components in a tilted normally-concealed state). The double arrow-headed line in FIG. 5D, and in FIGS. 6B, 6C, 6D, 6F, 6G and 6H, generally indicates the extent of movement of positionable mist-dispensing means 40 between a reduced-profile state and an extended-profile state, provided by suitable positioning means e.g., mechanically configured to slidably, rotatably or pivotably position the mist-dispensing means 40 between the two states. Explanations of various positionable mist-dispensing means configurations will be provided in detail in subsequent descriptions to follow. In FIGS. 5D and 5E urinal 10 is shown being retained or mounted to panel 22 in a fixed manner by suitable mounting means such as one or more mounting bracket 74 and optionally fitted with a fixed, or positionable (manually or mechanically actuated) splash guard 72 which is depicted extending upward adjacent from an upper opening of urinal receptacle 30. Thus, a positioning of panel 22 from the opened state depicted in FIG. 5D to a closed state depicted in 5E causes the urinal to be concealed and stored in a tilted manner. To facilitate drainage while in a tilted state, the urinal may optionally be configured with a waste-liquid line 102 having a receiving end which is coupled to one or more liquid-conducting outlets, or to an elongated outlet or drain located along a perimeter portion of urinal receptacle 30. Thus, when the urinal is upright or tilted the receiving end of the waste-liquid line 102 will collect waste-liquid and conduct it to suitable waste-liquid drainage means. Preferably panel 22 when configured to be pivotable is also equipped with a hinged panel retainer 38, stop or damper member, which pre-disposes the door to open, or open smoothly in a dampened manner, to a predetermined extended-for-use point. It is noted that when a hinged panel retainer 38 is employed as in, or similar to, FIGS. 5D and 5E, that a linkage coupling can optionally be made between a central pivot point of the retainer and a portion of the positionable mist-dispensing means 40, such that capturing and employing, or leveraging, of the up and down movement of the pivot point may be applied it a positioning of the mist-dispensing means (linkage not shown). Thus, as panel 22 is moved to a fully extended opened state the mist-dispensing means will correspondingly be moved by the coupled linkage to an extended-profile state, and conversely, when panel 22 is moved to a closed state the mist-dispensing means will be moved to a reduced-profile state.

Referring to FIGS. 6A through 6H, in FIG. 6A partial cabinet-height positionable panels 16 (referred hereafter in the descriptions of FIGS. 6A through 6H as "panel 16") are shown in a normally-closed position I FIG. 6A, occupying no more space within the room that the cabinet is installed in, or installable in, than would be occupied by a typical closed door or drawer of customary cabinetry. In FIG. 6B panel 16 is configured to be slidably operable in a drawer-like manner with suitable slidable positioning means 24 and is shown in an opened, extended-for-use position, with the urinal (or a portion of the urinal or urinal receptacle) mounted or releasably attached to an interior-facing surface of panel 16. In FIG. 6C panel 16 is configured with one or more hinge 68 to be pivotably operable in a door-like manner and is shown in an opened, extended-for-use position, with the urinal (or a portion of the urinal or urinal receptacle) mounted or releasably attached to an interior-facing surface of panel. While panel 16 of FIG. 6C is depicted generally in a 90° orientation (to a forward-facing side of the cabinetry) it is noted that any of the embodiments incorporating a pivotable door may be configured to exceed a pivot range of 90° (e.g., up to 180° or more). In FIG. 6D panel 16 is configured to be pivotably operable in a door-like manner which pivots, or is hinged, along a horizontal axis located at or near the lower end of panel 16 (when the panel is in a closed state) and is preferably equipped with return means such as a spring, linkage or leveraged linkage which facilitates a closing of panel 16 as the urinal is moved to a concealed state. In operation, as panel 16 is moved from a closed state as depicted in FIG. 6A, to an opened state as depicted in FIG. 6D, a positionable horizontal member 110 which supports urinal 10 and which is mechanically associated and linked with panel 16, is moved outwardly to the position depicted in FIG. 6D. Conversely, a moving of the urinal, or member 110 from an extended-for-use state to a closed state (by manual or powered mechanical actuating means) causes panel 16 to also be moved to a closed state by any of the aforementioned return means. In FIG. 6E an end of the customary cabinetry 12 is depicted in a full cut-away view to illustrate the urinal and associated plumbing components. A dashed-line is shown extending from an outlet end of a waste-liquid line 102 to indicate a flexible tube or hose which, in a water-tight manner, is fitted within, or fed into, an aperture or grommet of a coupling (or alternatively a pipe) made to connect with plumbing components typically configured to lead to drainage means, or to a sewer pipe. Preferably the outlet end of the flexible tube or hose is located or installed at a lowest point in the conduit path to facilitate a siphoning of waste liquids provided from one or more liquid-conducting outlets of a urinal receptacle 30. It is noted that the positionable urinal and mist-dispensing means of the present invention are equipped with a sufficient length of one or more flexible tubes or hoses, or rigid tube(s) configured in a telescoping, or pivotably-jointed expandable and contractible manner, to serve as a water line 102 and a waste-liquid line 100 which accommodates the full range of movement of a panel 16 or 22. For example, a length of flexible tubing shown in a dashed line in FIG. 6E is shown extending between an outlet end of waste-liquid line 102 and the aforementioned adapted coupling or pipe, to accommodate positioning of the urinal between a concealed state and an extended-for-use state. The urinal 10 of FIGS. 6F through 6H are similar in structure and operation to the variants depicted in FIGS. 6B through 6D respectively, with the exception that each positionable panel 16 is slidably or pivotably mounted at an intermediate or 'middle' height instead of occupying the uppermost door or drawer position. The dashed-line rectangles of FIGS. 7A and 7B indicate a non-standard panel opening (112) formed or cut within an area, portion or side of customary cabinetry 12 not occupied by a door or drawer. For example, a non-standard panel opening 112 is shown cut or formed on an end of customary cabinetry whose forward-facing side has at least one full cabinet-height drawer or door 22 in FIG. 7A, or at least three partial cabinet-height drawers or doors 16 in FIG. 7B. Thus, existing or customary cabinetry may optionally be modified in a way that preserves its normal forward-facing features, and/or provides urinal access at an end of a cabinet that may be more ideally or optimally located for use within a room.

As previously mentioned, the space-saving, or double space-saving aspects of the present invention are also employable in embodiments of the urinal and mist-dispensing means configured relatively alignable to one another and installable into a wall opening (e.g., of a room). Whether configured fixed for alignment in concert with a positionable urinal receptacle, or configured separately positionable between reduced-profile and extended-profile states, the mist-dispensing means are configured to maintain or provide alignment of a distributed misted spray volume with a urinal receptacle interior surface which facilitates a repelling of waste liquid from, and a self-cleaning of, the urinal-receptacle surface in an efficient very low water-usage manner.

Figure 9B:
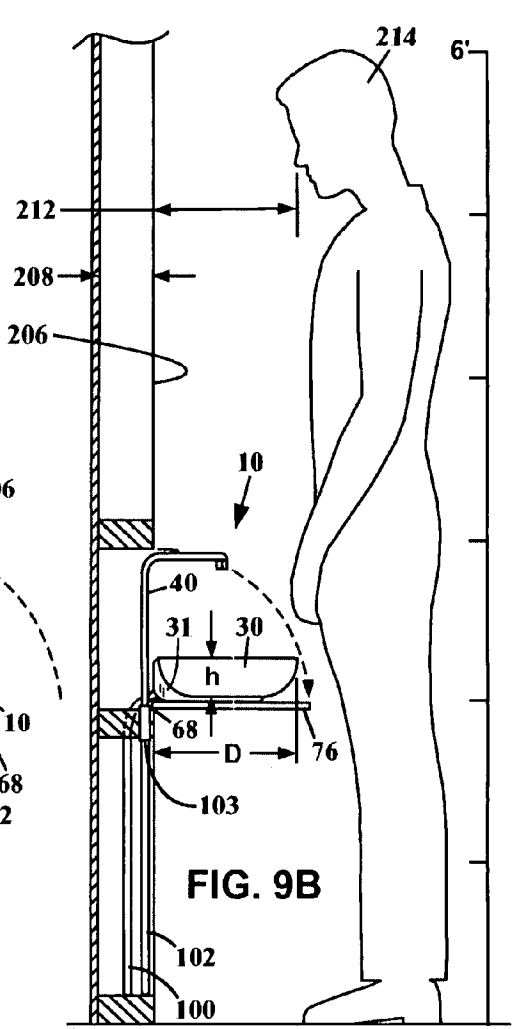
FIGS. 8 and 9A-9B are two-dimensional cut-away side views of a portion of a building code standardized or customary wall, contrasting an atypical user-proximity to a wall provided by a higher-than-deep (H>d) high-water usage urinal (in FIG. 8—Prior Art), and a conventional user-proximity to a wall provided by a deeper-than-high (D>h) urinal with very low water-usage mist-dispensing means, pivotally positionable between a concealed, zero-footprint state and an extended-for-use state (in FIGS. 9A-9B).
Figure 9A:
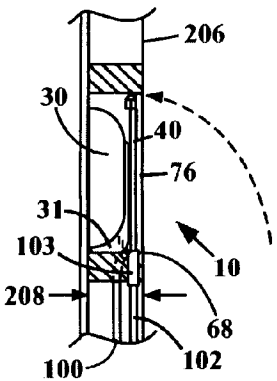
FIG. 9A PRIOR ART
Figure 8:
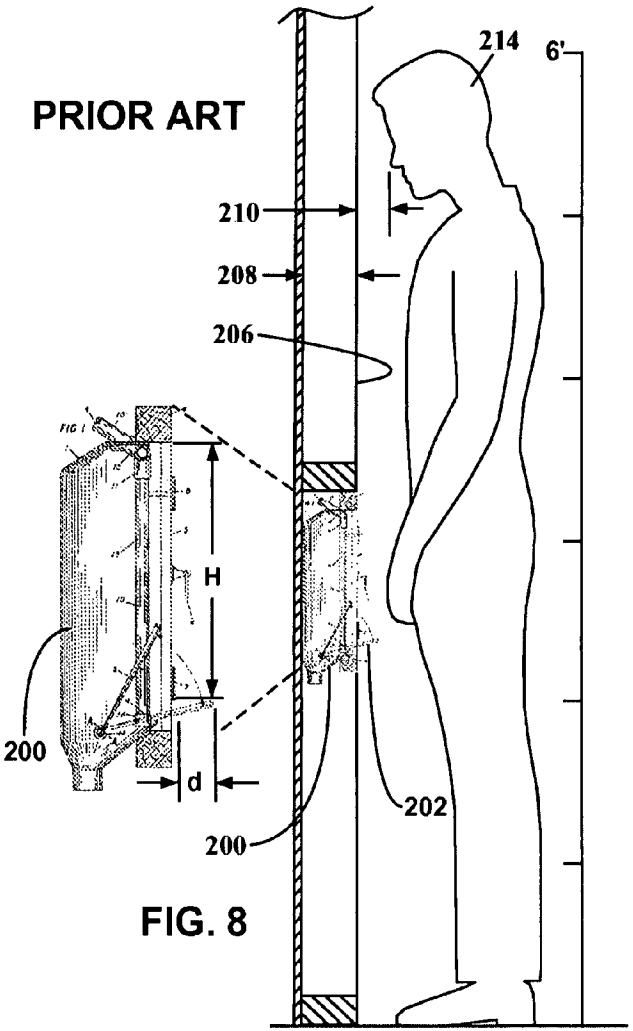

In FIGS. 9A and 9B a wall-mounted urinal embodiment of the present invention is contrasted with a prior art approach shown in FIG. 8 (Brunton U.S. Pat. No. 4,488,321). In FIG. 8 the prior art wall-mountable urinal 200 is scaled proportionately (scaling indicated by diagonal dashed lines) to a maximum size installable within, and in compliance with, a building code-standardized stud or wall depth 208 of a customary wall (slightly less than 4"). The Brunton urinal 200 is configured with a vertically-arranged urinal receptacle opening having a height>depth ratio which determines a user proximity to outward-facing wall surface 206 during a use-cycle. As shown in FIG. 8, the urinal-receptacle opening height "H" is over 6× greater in height than the extended-for-use depth "d" provided by urinal pivot member 202. Thus, it can be seen that when the pivot member 202 is fully extended (with urinal 200 proportionally scaled to fit in a customary wall) the face of a six foot tall user 214 would be at an uncomfortable, or non-ergonomic spacing 210 approximately 2-3 inches (estimate) from wall surface 206 during each urinal use-cycle. In contrast, embodiments of the present invention provide a positionable urinal receptacle 30 having a depth>height ratio improvement which defines a more comfortable, customary spacing 212 between user 214 (in FIG. 9B) and outward-facing wall surface 206, wherein, an extended-for-use depth "D" of the urinal-receptacle 30 i.e., extending outwardly beyond the wall, is significantly larger than the urinal height "h," and very low water-usage mist-dispensing means 40 positionable between a reduced-profile state (in FIG. 9A) and an extended-profile state (in FIG. 9B) are configured positionable to provide a distributed misted spray volume correctly aligned with the urinal receptacle 30 which facilitates a repelling of waste liquid on, and a self-cleaning of, the urinal-receptacle surface in a very low water-usage manner. Referring in more detail to FIGS. 9A and 9B, in FIG. 9A a urinal receptacle 30 is shown mounted to a normally interior-facing surface of a positionable wall panel 76. In response to a positioning of panel 76 to a normally-closed state (indicated by the adjacent arrow-headed dashed-line arc) pivoting approximately 90° about a horizontal pivot axis of hinge 68, the positionable urinal 10, suitably mounted to the panel, is concealed within a customary wall having a building code-standardized stud or wall depth 208. When in the concealed, normally-closed state (depicted in FIG. 9A), a water-line swivel coupling 103 mounted at an upper end of water line 102 provides pivotal coupling with mist-dispensing means 40 to facilitate a pivoting of the mist-dispensing means about a vertical axis, between a reduced-profile state (e.g., shown in FIG. 9A) and an extended-profile state (e.g., shown in FIG. 9B). Optionally, through suitable linkage and/or transmission means, a motion associated with a positioning of panel 16 may be coupled to mist-dispensing means 40 or a member or element thereof, such as a gear, control arm or cable, whereby an alignment of a distributed misted spray volume with the interior surface of the receptacle 30 occurs when the panel is fully opened, which prevents retention of waste liquid on, and provides a self-cleaning of, the urinal-receptacle surface in an efficient very low water usage manner. Similarly, the same components may be configured to capture an opposite motion associated with a positioning of panel 16 to a closed position. To facilitate drainage of the urinal receptacle 30 while in, or in between, an extended-for-use and reduced-profile state, preferably a dual-outlet conduit 31 is provided adjacent to the receptacle which collects liquids from one or more drains on the bottom of the receptacle, for example during a use-cycle (FIG. 9B), and from one or more drains on a side of the receptacle when stored within a customary wall depth 208, and in either case, directs the liquids via suitable coupling with an upper end of waste-liquid line 100.

While Brunton describes the employment of a fixed vertically oriented urinal with a pivot plate mountable within a wall, his invention was filed at a time when there was not the heightened need to conserve limited water resources that are now, and henceforth will be, consumed by significantly larger, and ever-increasing populations. Consequently there is no description of the Brunton urinal 200 being configured with very low water-usage mist-dispensing means. Brunton instead employs a customary streaming flow of water to flush an interior surface of his urinal, and thus would not provide water-use reductions significantly better than the typical one-gallon per flush (1 gpf) 'low water use' urinals already broadly in use. In contrast, the positionable aligning between a mist-dispensing means and urinal-receptacle of the present invention provides substantial reductions in water usage, for example, using only a small fraction of the 1 gpf standard e.g., in the single-digit percent range.

It is also noted that improved means for significantly or substantially reducing water-usage can also accrue significant savings in energy-usage, as a common method of distributing water often entails the use of energy-consuming water pumps. Accordingly, substantial decreases in water usage can mean significant reductions in energy use. Thus, an incorporating of the Brunton invention within a wall would do very little to reduce energy and water consumption particularly in densely populated areas and/or areas or dry regions having a dwindling, decreased or scant water supply. In contrast, the urinal of the present invention, depending on the components employed in its mist-dispensing means, can save for example 90-95% of the water-pumping energy consumed by a standard one-gallon per flush urinal. Accordingly, a substantial improvement in reduced water and energy consumption is provided by the present invention versus the Brunton approach.

Figure 10A:
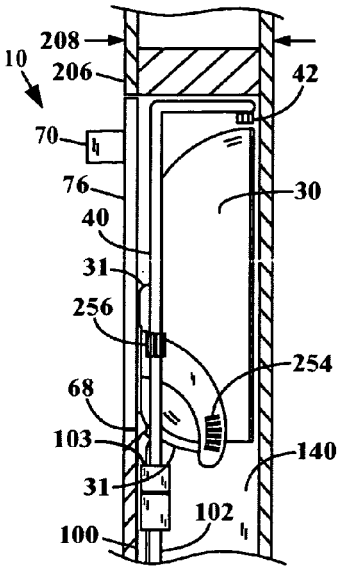
FIGS. 10A through 10D are two-dimensional cut-away side views of a urinal and very low water-usage mist-dispensing means, pivotally positionable between a concealed, zero-footprint state, from within a building code standardized or customary wall, to an extended-for-use state, and illustrate a rack gear member extending outward from an interior surface of a pivotally positionable panel, which controls a pivoting of the mist-dispensing means between reduced-profile and extended-profile states.
Figure 10B:
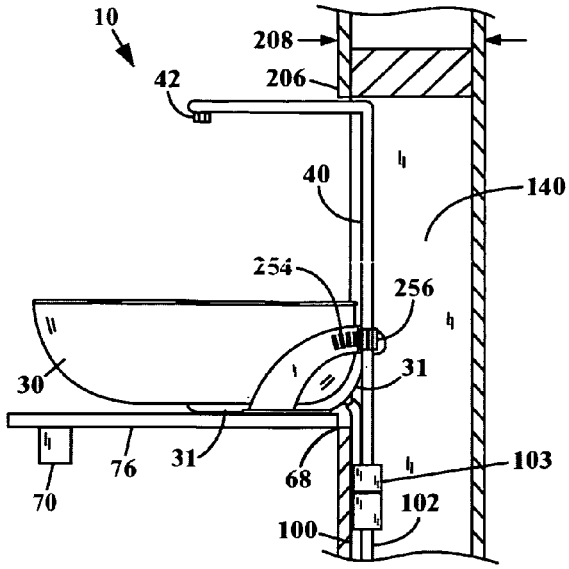
Figure 10C:
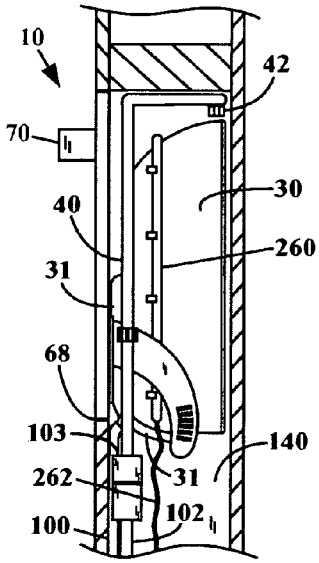
Figure 10D:
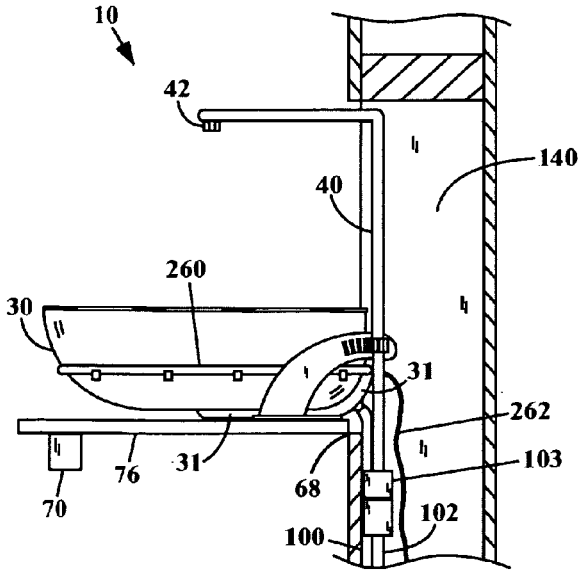

In reference to FIGS. 10A, 10B, 10C and 10D, an embodiment of a positionable urinal 10 configured wall mountable, is depicted in two-dimensional views, having a urinal-receptacle 30 sized to fit and be installed within an interior volume 140 of a wall, a customary wall, or wall having a building code-standardized stud spacing 208. In FIGS. 10A through 10D the urinal is shown mounted on an interior-surface of a positionable wall panel 76, with the panel and urinal receptacle in a vertical orientation in FIGS. 10A and 10C, and in a horizontal orientation in FIGS. 10B and 10D. In FIG. 10B the urinal is shown mounted on a normally-interior surface of a positionable wall panel 76 having been pivoted outwardly about one or more horizontally arranged hinges 68, to extend from interior wall volume 140 to an extended-for-use position well beyond wall surface 206. The wall panel 76 is equipped with pivot transmission means configured to translate a pivoting of panel 76 into a pivoting mist-dispensing means 40. For example pivot transmission may comprise a rack and pinion gear arrangement whereby a positioning of the panel and associated rack gear between an opened and closed state correspondingly positions (pivots) a pinion gear 256 and mist-dispensing means 40 between an extended-profile state (FIGS. 10B and 10D) and a reduced-profile state (FIGS. 10A and 10C). To facilitate a predetermined pivoting mist-dispensing means 40 is mounted to an upper end of a water-line swivel coupling 103 (e.g., similar to the swivel coupling of a pivotable faucet), which in turn is mounted at an upper end of water-line 102. During operation, a user manually pivots panel 76 about the one or more hinges, for example by clasping handle 70 and pulling the handle out and down, until the panel is generally horizontal as shown in FIGS. 10B and 10D. As the panel is rotated (in either direction) a rack gear 254 formed on a member extending outward from an interior facing side of panel 76 engages and rotates a pinion gear 256 coaxially mounted along a vertical portion of mist-dispensing means 40 to provide an optimal pivoting of the latter within a predetermined pivot range (e.g., between the extended-profile and reduced-profile states. Embodiments incorporating powered mechanical actuating means are equipped with a positionable actuation member suitably attached to the panel (or other structural member associated with and movable with the panel) which in response to a manually operated, or automated, switch (or valve) moves the wall panel 76, respective rack gear 254, pinion gear 256 and mist-dispensing means 40 within a predetermined pivot range.

The urinal embodiment illustrated in FIGS. 10C and 10D is structurally and operationally similar as that of FIGS. 10A and 10B but is additionally equipped with urinal lighting means 260, for example, lighting means configured to be moved in concert with urinal receptacle 30. The lighting means may comprise any form of light-emitting or photo luminescent material and/or components, for example including, but not limited to, one or more among the following: low-voltage and/or low-wattage lighting components; direct current powered lighting; alternating current powered lighting; battery or rechargeable battery powered lighting; lighting connected with one or more solar panels; L.E.D. lighting; incandescent lighting; fluorescent lighting; neon lighting; colored lighting; a plurality of electric lights; a string of electric lights; one or more tube lights shaped to conform to a portion of a urinal receptacle; one or more lights mountable adjacent to a surface portion of a rim of, or mountable above, a urinal receptacle; one or more lights mountable on a portion of a fixed or positionable mist-dispensing means and configured to provide lighting on an at least an interior surface area of a urinal receptacle include; and the like. Preferably when urinal lighting means 260 are configured as depicted in FIGS. 10C and 10D, urinal receptacle 30 is comprised of a translucent or transparent material that allows light to be seen through the material. When urinal lighting means 260 is electronically powered by a conventional electrical power supply an electrical power cord 262 (such as a low-voltage power cord) is connectable between the power supply and the lighting means. It is noted that one or more of the urinal embodiments described herein can also be installed in portable or transportable restroom facilities and may also be equipped with urinal lighting means.

Figure 11A:
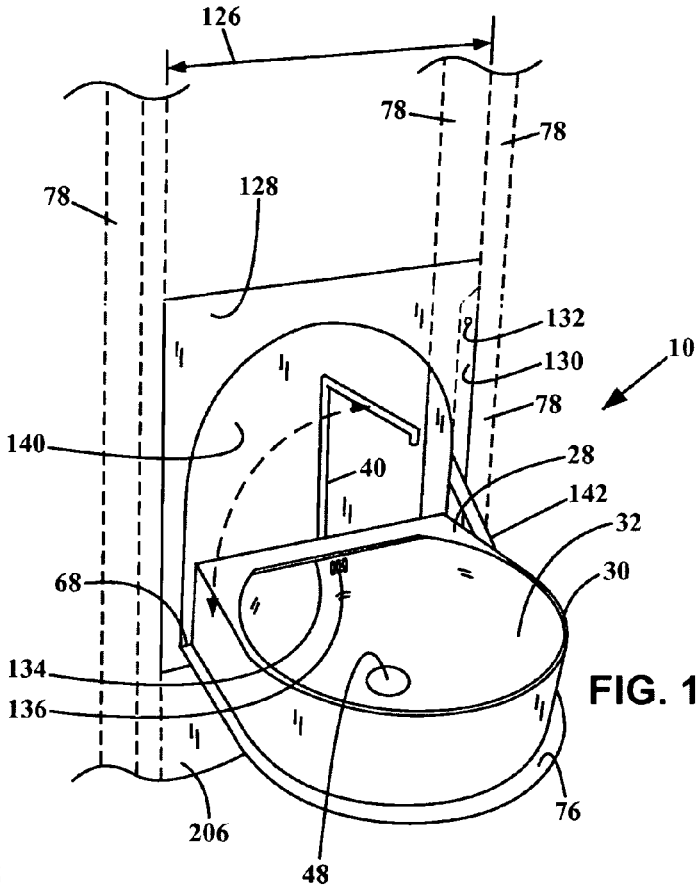
FIGS. 11A, 11B and 11C are three-dimensional views of a frame-mountable urinal and very low water-usage mist-dispensing means pivotally positionable between a concealed, zero-footprint state from within a building code standardized or customary wall (in FIGS. 11B and 11C) to an extended-for-use state (in FIG. 11A), with the frame sized for mounting within a standardized stud-spacing.
Figure 11B:
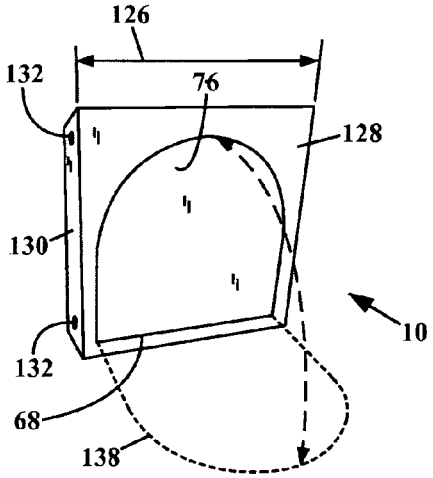
Figure 11C:
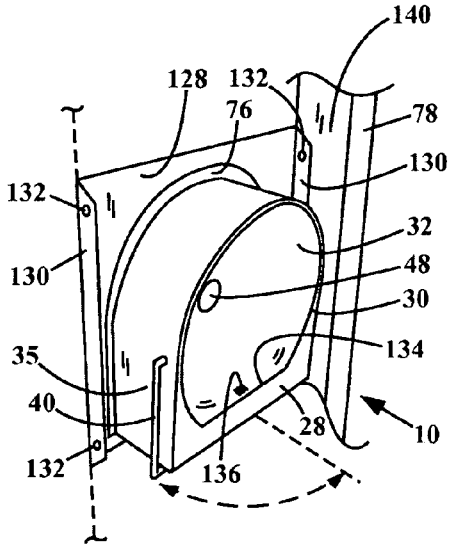

In reference to FIGS. 11A, 11B and 11C, a urinal 10 is depicted in three-dimensional views, and configured wall mountable, having a urinal wall mounting frame 128 sized to fit and be installed within a wall, a customary wall, or wall having a building code-standardized stud spacing 126. The mounting frame is configured for mounting to one or more wall frame members such as building code-standardized studs 78, preferably having one or more frame flanges 130 with mounting frame apertures 132 sized to receive a wall fastener such as a screw, nail or bolt (or otherwise configured for mounting with one or more common hardware components). Alternatively urinal 10 may be configured mountable on, or supportable on one or more brackets, pivot points, joints, braces, sides, edges, and the like.

In FIG. 11A the urinal is shown mounted on an interior-surface of a positionable wall panel 76 and having been pivoted outwardly, from an interior wall volume 140, about one or more horizontally arranged hinges 68 to extend well beyond wall surface 206, in an extended-for-use position. Through suitable linkage coupled between wall panel 76 (or a member associated with the panel) and a pivotally positionable mist-dispensing means 40, the latter is moved between a reduced-profile state located adjacent to a urinal side 35 e.g., as depicted in FIG. 11C, and an extended-profile depicted in FIG. 11A to provide as previously described a distributed misted spray volume in correct alignment with urinal receptacle surface 32 (of receptacle 30). The double arrow-headed arced lines shown in FIGS. 11A and 11C indicate an example of a pivot path of the mist-dispensing means 40 when pivoting around a transverse axis by a manual positioning or powered mechanical actuating means. The isometric view of FIG. 11C depicts urinal 10 in a normally-concealed position as seen within a portion of an interior wall volume 140. Optionally or alternatively, the urinal 10 may be equipped with one or more urinal side drains 136 and a urinal liquid-retaining rim 134 formed adjacent to a perimeter portion of receptacle 30 or an optional urinal top 28, which capture and conduct liquids to a waste liquid conduit (preferably shared by one or more urinal drain outlets 48) when the urinal is rotated to its normally concealed position depicted in FIGS. 11B and 10C. To ensure that the urinal is rotated to a predetermined extended-for-use position, a urinal-travel stop 142 such as a strut, rod or cable (or other pivot limiting and/or dampening means) is preferably employed.

Through suitable linkage coupled between positionable wall panel 76 (or a member associated with the panel) and a pivotally positionable mist-dispensing means 40, the latter is moved between a reduced-profile state located adjacent to a urinal side 35 e.g., as depicted in FIG. 11C, and an extended-profile depicted in FIG. 11A to provide, as previously described, a distributed misted spray volume in correct alignment with urinal receptacle surface 32 (of receptacle 30). The double arrow-headed arced lines shown in FIGS. 11A and 11C indicate an example of a pivot path of the mist-dispensing means 40 when pivoting around a transverse axis by a manual positioning or powered mechanical actuating means. The isometric view of FIG. 11C depicts urinal 10 in a normally-concealed position as seen within a portion of an interior wall volume 140. Optionally or alternatively, the urinal 10 may be equipped with one or more urinal side drains 136 and a urinal liquid-retaining rim 134 formed adjacent to a perimeter portion of receptacle 30 or an optional urinal top 28, which capture and conduct liquids to a waste liquid conduit (preferably shared by one or more urinal drain outlets 48) when the urinal is rotated to its normally concealed position depicted in FIGS. 11B and 10C. To ensure that the urinal is rotated to a predetermined extended-for-use position, a urinal-travel stop 142 such as a strut, rod or cable (or other pivot limiting and/or dampening means) is preferably employed.

To install the urinal wall mounting frame 128, an opening of a predetermined size, generally corresponding to the size of the outside perimeter of the frame, is made within a wall between two studs 78 at an optimal height above a floor (or other surface that a user stands on). One or more water line holes are drilled in studs located between the urinal and a waste-liquid outlet, drain, conduit, receptacle or sewer pipe, through which is inserted a waste-liquid line attached at an upper end with a urinal drain conduit, and a water line attached at an upper end with mist-dispensing means (not shown). Once installed, urinal 10 is then positionable by pivoting positionable wall panel 76 (and attached urinal) from a closed position to a panel extended position 138 (indicated in a dashed-line outline in FIG. 11B, and as illustrated in FIG. 11A).

Figure 12A:
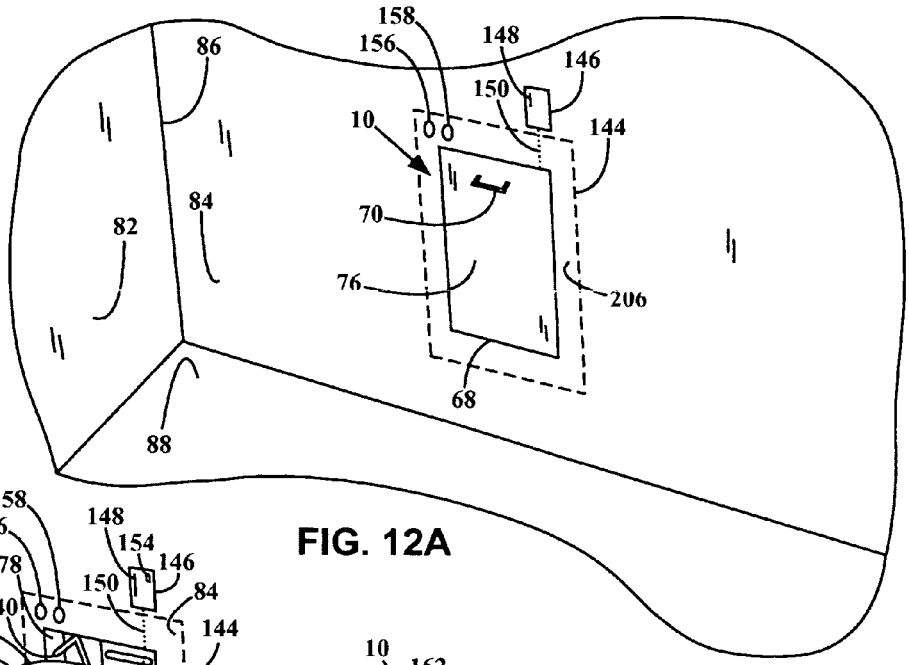
FIGS. 12A and 12B are three-dimensional views of a door-like positionable panel, pivotable about a lower horizontal hinged axis, configured to position a urinal and very low water-usage mist-dispensing means between a concealed, zero-footprint state from within a building code standardized or customary wall (in FIG. 12A), to an extended-for-use state (in FIG. 12B). Optional manual switch means, and an optional pay-per-use mechanism are also shown.
Figure 12B:
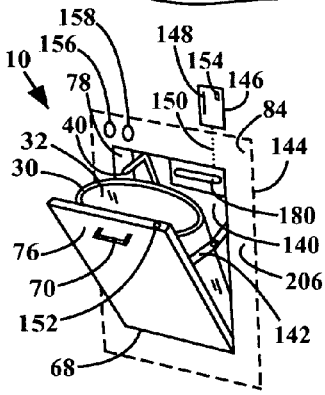
Figure 13A:
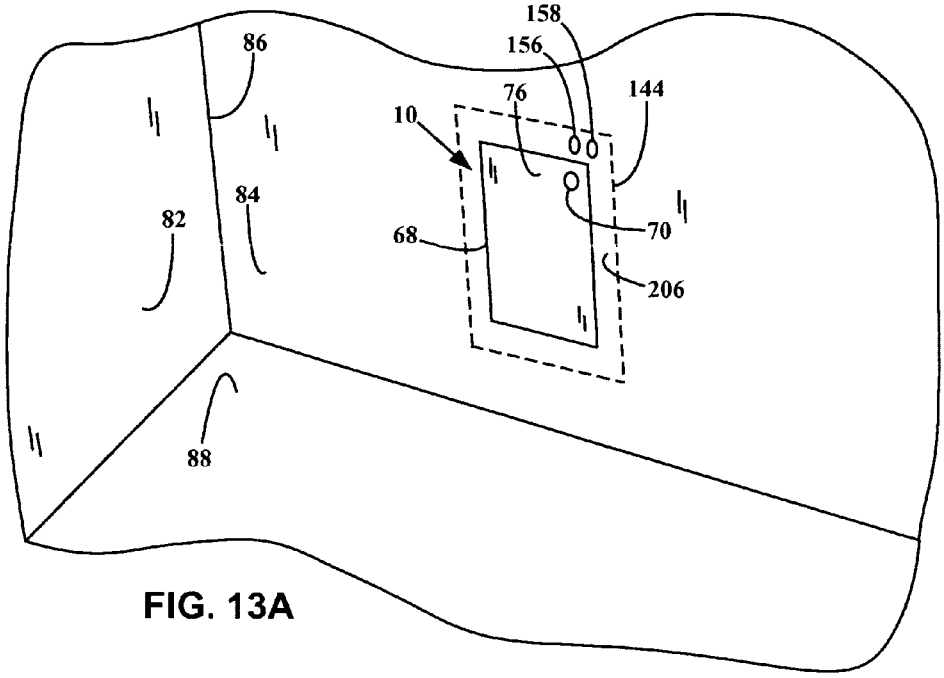
FIGS. 13A and 13B are three-dimensional views of a portion of a building code standardized or customary wall, shown within a portion of a room (in FIG. 13A), with the wall being equipped with a door-like positionable panel configured with a depth-expandable urinal and variable-height, very low water-usage mist-dispensing means, pivotally positionable about a side vertical hinged axis, between a concealed, zero-footprint state (in FIG. 13A) and an extended-for-use state (in FIG. 13B).
Figure 13B:
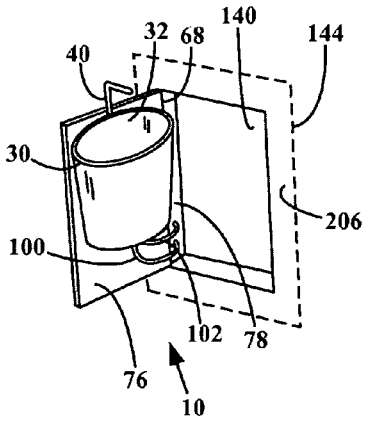
Figure 13C:
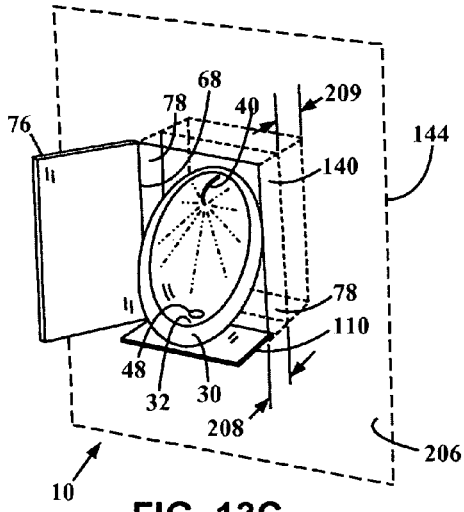
FIG. 13C shows a urinal and mist-dispensing means slidably positionable in concert, with the urinal having a depth greater than a building code standardized or customary wall, and installable: to extend beyond the wall; to extend into an enclosure mounted to an opposite side of the wall in an adjacent room or area; into a wall having a non-standard or extended wall depth.

In FIGS. 12A, 12B, and 13A, 13B and 13C a urinal 10 is depicted in three-dimensional views within a portion of a room (outlined in a solid black line in FIGS. 12A and 13A) comprising a side wall 82, a rear wall 84, and floor 88. Within a portion of the rear wall 84, defined by a dashed-line rectangle 144 (also shown in FIGS. 13B and 13C), a urinal 10 and mist-dispensing means 40 are configured wall mountable and positionable, for example behind a wall panel 76 which in FIGS. 12A and 12B is hinged at a lower end by one or more horizontal hinges 68 (or other suitable pivot means), and in FIGS. 13A, 13B and 13C is shown hinged along a side by one or more vertical hinges 68. Preferably urinal 10 is sized for mounting within an interior wall volume 140 between two studs 78 of rear wall 84 which is in compliance with code-standardized width and depth dimensional requirements and a urinal sized to fit therein. However, it is noted that wall mountable embodiments of the present invention can also be provided for non-customary walls>4" in depth, or walls formed between a room the urinal operates in and is accessible from, and an adjacent room, such as a storage room, area or closet (preferably seldom seen), wherein an interior wall volume depth (and optionally an enclosure encasing the volume) extends into the adjacent room to accommodate a urinal greater than the depth of the wall. For example, FIG. 13C depicts a rearwardly-extended interior volume depth 209 added to the rear portion of a wall, which is sized to accommodate the width and depth of a slidably positionable horizontal member 110 supporting a urinal receptacle 30 and mist-dispensing means 40. The extended interior volume depth 209 is shown augmenting or adding to a building code-standardized stud or wall depth 208 (depths 208 and 209 are outlined in dashed lines) or interior volume 140, and preferably is enclosed within a housing or enclosure which extends, by depth 209, into an adjacent room or space to conceal from view (from that room or space) the back side of the urinal. In operation, panel 76 is manually, or by powered mechanical actuating means, positioned clear of the positionable urinal path (for example, slid up or out of the way, or pivoted about one or more vertical hinges 68) and slidably positionable horizontal member 110 is positioned forward to place both the urinal receptacle 30 and mist-dispensing means 40 in an extended-for-use position. Following a use-cycle, slidably positionable horizontal member 110, supporting a urinal receptacle 30 and mist-dispensing means 40, is positioned rearward into both interior volume 140 and rearwardly-extended interior volume depth 209 and any associated panel is moved to a closed or urinal concealing position. Accordingly, positionable urinals (with associated mist-dispensing means) having a depth>4" are easily accommodated by adding to a rear portion of a wall, a rearwardly-extended interior volume depth 209. FIG. 13C also illustrates very low water-usage mist-dispensing means, positionable in concert with urinal receptacle 30, extending downward and configured to spray a distributed misted spray volume (depicted in dotted-and-dashed lines) which is directed inward and downward onto a urinal receptacle surface 32.

Alternatively, a urinal can be mounted within a wall between two rooms (FIGS. 12C, 12D and 12E) configured between two opposing positionable wall panels 76 each hinged to a wall of a respective room, whereby a urinal receptacle is made pivotally accessible from, and can alternately pivot into, either room, serving two rooms in a cost-saving manner with just one urinal.

In reference to FIGS. 12A and 12B, a positionable wall panel 76 is shown in FIG. 12A in a normally-closed position, generally flush with outward-facing wall surface 206, thereby occupying no additional space within the interior of the room when concealing and storing a positionable urinal and mist-dispensing means between use-cycles. As previously described, the positionable panel can be positioned between the closed position (of FIG. 12A) and extended-for-use position (of FIG. 12B) by manual or powered mechanical actuating means. For example, the panel may be manually positioned by a user employing an extended or recessed handle 70 to pull the panel outward to a predetermined point e.g., determined by urinal-travel stop 142. When one or more powered mechanical actuating means are incorporated each is/are configurable responsive to actuator control means, such as (but not limited to) one or more among the following: a single activating and de-activating button, switch, toggle-switch or valve; an electronic proximity, heat or motion sensor; wireless signal reception means equipped to receive a wireless communication transmittable from a handheld wireless device, remote control device or transmitter; the combination of an activating button, switch or valve 156 and a de-activating button, switch or valve 158, and the like. Accordingly, actuator control means are configurable to control any among the powered mechanical actuating means previously or subsequently described herein.

In FIG. 12B a urinal receptacle 30 and mist-dispensing means 40 (configurable fixed, or positionable between reduced-profile and extended-profile states as previously described) are collectively associated with an interior surface of positionable wall panel 76 such that a positioning of the latter causes a corresponding positioning of, and operative alignment between, the urinal receptacle 30 and mist-dispensing means 40, which in turn provides a distributed misted spray volume onto the urinal receptacle surface 32 preventing retention of waste liquid on, and facilitating a self-cleaning of, the urinal-receptacle surface in an efficient very low water usage manner. It is noted that while FIG. 12B depicts a generally L-shaped mist-dispensing means 40 which extends upwardly and then forward toward a user position from behind a rear portion of the urinal receptacle 30, that an L-shaped mist-dispensing means (or other shaped variant) may instead be mounted in a different location, for example, adjacent to a side of the urinal receptacle 30 and configured so that an upper portion of the positionable mist-dispensing means extends laterally over the receptacle (e.g., as depicted in FIGS. 12C, 12D and 12E).

In circumstances or environments where it may be advantageous to provide reduced water-usage, improved hygienic conditions, a recouping of maintenance and/or operational costs, or enhanced security of plumbing fixtures, a urinal 10 may be equipped with locking and unlocking means, operable by a physical key, combination lock, or a pay-per-use apparatus 146 configured to unlock the urinal in response to receiving one or more forms of payment, such as a payment made with: cash, a credit or debit card, a membership card, a card having a magnetic strip, a card or other portable product having an RFID chip (or other electronically transmittable data), credits, or pre-payments, and the like. Alternatively or additionally the apparatus may be equipped to receive a wireless communication and/or payment transmittable from a handheld wireless device, cell phone, remote control device, and the like. For example, a pay-per-use apparatus 146 may be configured in a typical manner having one or more payment insert slots 148 for the inserting of a payment card and/or handling cash payments (and optionally handling and dispensing change), and/or may include a wireless signal reception port 154, and configured in response to receiving a payment, to: disengage a lock member 150 from a corresponding lock member receptor located on a portion of a positionable panel e.g., a lock member aperture 152; and, following a paid-for use-cycle and a closing of the panel, to re-engage lock member 150 in the lock member aperture 152. Optionally, a personal hygiene product dispenser 180 equipped to dispense one or more products may be mounted within an available interior space within interior wall volume 140 such that the dispenser is accessible to a user when the positionable wall panel is in an opened state, and the contents of the dispenser are safeguarded when the panel is in a closed/locked state.

In certain embodiments of the present invention, the urinal receptacle 30 may be made of a generally rigid material, resilient material, flexible material, or a material adapted to be repeatedly expanded and contracted, including, but not limited to, any one or more among the following materials and/or coatings, or properties: metals; alloys; plastics; Teflon®; hydrophobic material or surfacing; silicon; carbon fiber; fiberglass; composites, rubber, textured, cast, marble, rock, cement, ceramics, porcelain; water-proof woods; veneers; laminated woods; opaque, translucent or transparent materials; painted, printed, silk-screened, embossed, photographic, holographic, photo luminescent, lighted, materials; and the like.

Figure 12C:
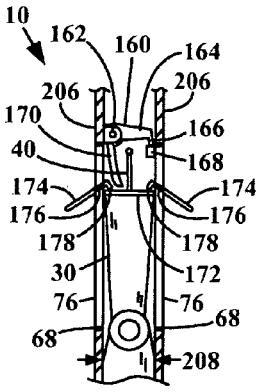
FIGS. 12C, 12D and 12E depict cut-away side views of an expandable-depth urinal (similar to the urinal of FIGS. 12A and 12B), additionally configured separately employable from opposite sides of the same wall.
Figure 12D:
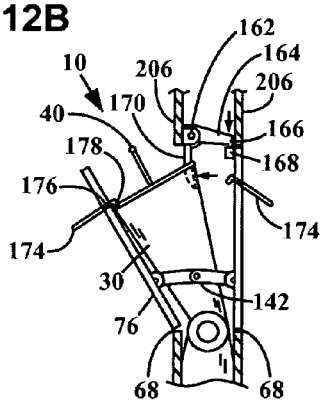
Figure 12E:
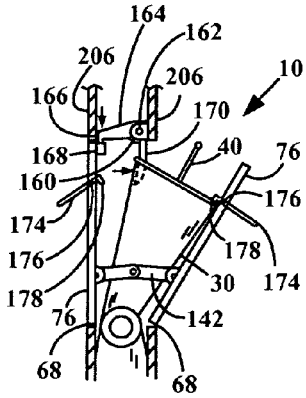

For example, in FIGS. 12C, 12D and 12E urinal receptacle 30 is made of a flexible material which is shown in a contracted, reduced-profile state in FIG. 12C having a depth in compliance with a building code-standardized stud or wall depth 208 of a customary wall (<4"). In FIGS. 12D and 12E urinal receptacle 30 is shown in a stretched or extended-profile state. It is noted that while the urinal depicted in FIGS. 12C, 12D and 12E is configured to be accessible from two positionable wall panels 76 each pivotally mounted on one or more hinges 68 on opposite sides of the same wall, that a similar urinal may instead be provided having just one of the two panels. Optionally, urinal receptacle 30 may also be equipped with a shape-forming perimeter-rim 172 for example, pre-disposed by an enlarged cross-section of receptacle material and/or by one or more incorporated springs or resilient materials to conform an upper opening of urinal receptacle 30 into an optimal extended-for-use shape e.g., an expanded oval or round shape, when positionable wall panel 76 is moved to an opened state.

Referring to FIGS. 12C and 12D, in operation, a pivot handle and receptacle hook 174 mounted on a handle pivot member 176 within an opening made in an upper central portion of a positionable wall panel 76 is clasped and lifted by a user, which in turn causes a handle receptacle hook 178 to engage an perimeter portion of an upper opening of urinal receptacle 30 (as depicted in FIGS. 12D and 12E). As positionable wall panel 76 is pivoted outwardly about one or more horizontal hinges 68, handle receptacle hook 178 correspondingly moves an upper opening of the receptacle and associated very low water-usage mist-dispensing means 40 outwardly, and a receptacle expander member 170 extending downwardly from a dual-control arm 160 pivotally mounted on a pivot mount 162, comes into contact with an opposite interior side of receptacle 30. For the purposes of simplifying the drawing figures, a single dual-control arm 160 is shown in FIGS. 12C through 12E, however it is noted with wall mountable urinals configured with two opposing wall panels, that the dual-control arm depicted in FIG. 12E would also be included with the dual-control arm in FIGS. 12C and 12D, and vice versa.

A continued outward movement of the panel 76 causes an expansion of the upper opening of receptacle 30 (and optionally, a shape-forming perimeter-rim 172) and also causes dual-control arm 160 to pivot, in the directions indicated by the horizontal and vertical arrows adjacent to the dual-control arm, which in turn causes an insertable lock tip 166 of a positionable locking member 164 of the dual-control arm to engage and lock within an upper opening of a lock tip receptor 168 mounted on an opposite positionable wall panel 76, thereby locking the latter, unused wall panel 76 in place. When the positioned panel 76 is moved to a predetermined extended state e.g., defined by urinal-travel stop 142, the urinal is placed in an extended-for-use state employable during a use-cycle. It is noted that while the mist-dispensing means 40 are depicted having a fixed-height relative to receptacle 30 in FIGS. 12B-12E, that the mist-dispensing means may alternatively be made positionable between a reduced-profile and extended-profile state, in which case, an upper opening or rim of receptacle 30 may instead be located adjacent, near or proximate to an upper end of a positional wall panel 76. And whether fixed (for alignment in concert with a positionable receptacle) or positionable, mist-dispensing means are aligned with urinal 30 receptacle during a use-cycle to provide a distributed misted spray volume on the interior surface of the receptacle, which prevents retention of waste liquid on, and provides a self-cleaning of, the urinal-receptacle surface in an efficient very low water usage manner. It is also noted that an upper portion of a positionable wall panel 76 extending above a urinal receptacle 30, when the panel is in a closed position, can alternatively be configured positionable separately from a lower wall panel portion e.g., by hinge or pivot means, such that the upper wall panel portion can be moved to a position un-obstructing the upper opening of the receptacle (not shown).

To manually return positionable wall panel 76 to a closed state, a user simply pushes the panel inwardly until it is flush with outward-facing wall surface 206 as depicted in FIG. 12C causing urinal receptacle 30 to contract within the interior wall volume between the opposing panels (76). Preferably each dual-control arm 160 is spring or weight biased to return the arm to the unlocked position shown in FIG. 12C when a respective positionable wall panel is moved to a closed position. Similarly, each pivot handle and receptacle hook 174 is preferably spring or weight biased to return the handle to a disengaged state when a respective positionable wall panel is moved to a closed position.

In reference to FIGS. 13A and 13B, a positionable wall panel 76 operable in a door-like manner is shown in FIG. 13A in a normally-closed position, generally flush with outward-facing wall surface 206 (within a portion of the rear wall 84 defined by a dashed-line rectangle 144), occupying no additional space within the interior of the room when concealing and storing a positionable urinal and mist-dispensing means between use-cycles. As previously mentioned, the panel is pivotally hinged along a side by one or more vertical hinges 68, and configured with a waste-liquid line 100 leading to a suitable waste-liquid outlet or receptacle, and a water line 102 coupled between a pressurized supply of water and mist-dispensing means 40. Preferably urinal 10 is sized to be stored within an interior wall volume 140 e.g., between two vertical studs 68 (only one is shown) and may be formed or made of any one or more among the aforementioned receptacle materials and/or material properties. As previously described, positionable panels of the present invention (e.g., operable from customary cabinetry or customary walls) can be positioned between the closed position (of FIG. 13A) and extended-for-use position (of FIG. 13B) by manual or powered mechanical actuating means. For example, the panel may be manually positioned by a user employing an extended or recessed handle 70 to pivot the panel outwardly to a desired or predetermined point. To manually return a positionable wall panel 76 to a closed state, a user simply pushes the panel inwardly until it is flush with outward-facing wall surface 206 as depicted in FIG. 12B. When one or more powered mechanical actuating means are incorporated for positioning one or more positionable elements or components of the present invention, each may be configured responsive to actuator control means, such as (but not limited to) any one or more among the powered mechanical actuating means previously or subsequently described herein, or among those that are made available commercially.

In FIG. 13B a urinal receptacle 30 and mist-dispensing means 40 (configurable fixed, or positionable between reduced-profile and extended-profile states as previously described) are shown collectively associated with an interior surface of positionable wall panel 76 such that a positioning of the panel causes a corresponding positioning of, and an alignment between, the urinal receptacle 30 and mist-dispensing means 40. The alignment provides a distributed misted spray volume onto the urinal receptacle surface 32 preventing retention of waste liquid on, and facilitating a self-cleaning of, the urinal-receptacle surface in an efficient very low water usage manner. FIG. 13B depicts a generally L-shaped mist-dispensing means 40 that extends upwardly and then forward toward a user position (during a use-cycle) from behind a rear portion of the urinal receptacle 30. Alternatively, L-shaped mist-dispensing means (or other shaped variant) may instead be mounted in a different location, for example, adjacent to a side of the urinal receptacle 30 and configured so that an upper portion of the positionable mist-dispensing means extends laterally over the receptacle (e.g., as depicted in FIGS. 12C, 12D and 12E).

While the embodiments illustrated in FIGS. 10A through 13B illustrate a urinal receptacle 30 and mist-dispensing means 40 (configurable fixed, or positionable between reduced-profile and extended-profile states) collectively associated with a positionable wall panel 76 pivotally mounted or hinged to a wall in a door-like manner, it is noted that drawer-like embodiments incorporating a positionable wall panel may also be provided. For example, structural and operational aspects pertaining to the previously described drawer-like embodiments (employable in customary cabinetry) may be applied to any positionable wall panel embodiment. It is also noted that the previously described option to install door-like embodiments having a depth greater than the wall in which they are mounted (e.g., extending into an adjacent room or space behind a wall) may also be applied to the drawer-like embodiments. And in each case, a positionable or maintained alignment between a mist-dispensing means and urinal-receptacle provides a distributed misted spray volume, and achieves substantial reductions in water usage, for example, using only a small fraction of the 1 gpf low water-use standard e.g., in the single-digit percent range.

In reference to FIGS. 14-19, each urinal 10 is shown equipped with one or more very low water-usage sprinkler-related products, configured positionable separately from and/or in concert with a urinal receptacle 30, and similar to the previously described positionable mister or mister-like elements of mist-dispensing means 40, use only a small fraction of the 1 gpf low water-use standard e.g., in the single-digit percent range. For example, such very low water-usage sprinkler-related products may be selected from, but not limited to, one or more of the following products, components or elements (whether positionable, fixed, adjustable, or selectively interchangeable): nozzles, pop-up sprinklers or sprinkler heads, rotors, emitters, micro-spray nozzles, foggers, micro bubblers, stream jets, and the like. In FIGS. 14-19, a urinal side 35 or urinal rear portion 37 of each urinal 10 is configurable mountable, or releasably attachable to a positionable panel (not shown). Optionally, the urinal embodiments depicted in FIGS. 14-19 may include a urinal top 28 configured adjacent to an upper side or perimeter portion of an upper opening of urinal receptacle 30.

Figure 14:
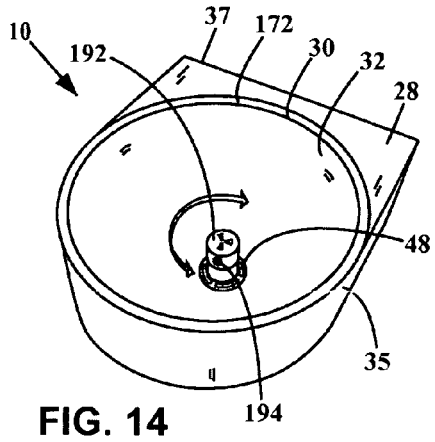
FIG. 14 is a three-dimensional view of a sprinkler-related product having a rotational sprinkler head incorporated in a lower interior portion of urinal receptacle, and configured with one or more very low water-usage nozzles transversely mounted on the rotational head at an angle which provides a distributed misted spray volume during rotation of the head.

In reference to FIG. 14, a sprinkler-related product having a rotational sprinkler head 192 is shown incorporated in a lower interior portion of urinal receptacle 30, and configured with one or more very low water-usage nozzles 194 transversely mounted on the rotational head at an angle which provides a distributed misted spray volume during rotation of the head, which is aligned to prevent retention of waste liquid on, and provide a self-cleaning of, urinal-receptacle surface 32. Optionally, rotational sprinkler head 192 may be selected from a type known as a pop-up sprinkler (or pop-up sprinkler head) which, when receiving a pressurized supply of water, lifts upwardly to a predetermined height, rotates at a predetermined or adjusted speed, and dispenses, according to the nozzles employed, a predetermined type and volume of spray or mist. When the pressurized supply of water is turned off, following a use-cycle, the spray ceases and the pop-up head retracts to a lower predetermined height.

It is noted that certain pop-up sprinkler heads, or rotatable sprinkler heads, are manufactured having a standardized nozzle opening which accepts any among a variety of interchangeable spray nozzles including nozzles having a predetermined spray arc width, or spray cone width, and made to emit a very low water-usage volume spray, mist or stream. Accordingly, in the embodiments of the present invention configured with a pop-up sprinkler head, or rotatable sprinkler head, having one or more standardized nozzle openings, it is preferable to incorporate a nozzle selected from among such interchangeable nozzle types, or to make and provide one or more customized interchangeable nozzles having an predetermined spray arc width, or spray cone width, made to emit a very low water-usage volume spray, mist or stream, optimized for use with, and for facilitating a self-cleaning of, a urinal receptacle.

In FIG. 14 a double arrow-headed arc (shown within receptacle 30) indicates rotation of the sprinkler head around a vertical axis, wherein the rotation may be in a single direction, or back and forth over a predetermined range, or degrees of arc. In either case the sprinkler head is equipped with one or more nozzles which emit a minimal water-usage volume spray, mist or stream, optimized for the rotation speed of the sprinkler head which effectively facilitates self-cleaning of a urinal receptacle.

To facilitate retention of water emitted within a urinal receptacle, the receptacle may be equipped with a receptacle rim 172 (or lip) configured to extend inwardly from an upper opening perimeter of the receptacle such that emitted water that would otherwise leave the bounds of a receptacle (without a rim 172) is retained within the receptacle by the receptacle rim. Additionally or alternatively, one or more water-emitting elements incorporated into a urinal 10 can each be configured with an adjacent overspray deflecting plate or member sized and shaped to restrict emitted water within the interior of a urinal receptacle.

Figure 16:
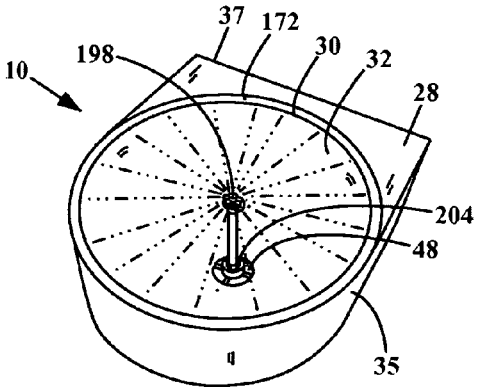
FIG. 16 is a three-dimensional view of a sprinkler-related product comprising an emitter mounted at an upper end of an elongated tube attachable to a sprinkler mount and configured to radially spray a plurality of very low water-usage streams at a urinal receptacle interior surface to facilitate a widespread splatter-induced mist collectively providing a distributed misted spray volume.
Figure 17:
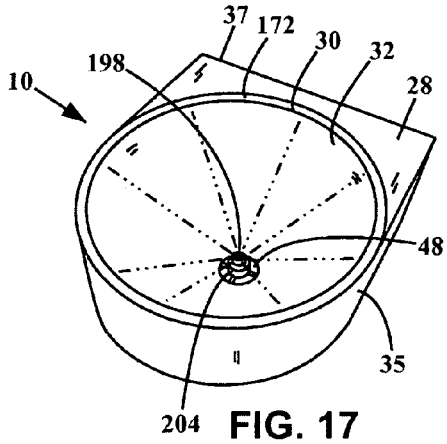
FIG. 17 is a three-dimensional view of a sprinkler-related product comprising an emitter mounted at an upper end of a sprinkler mount and configured to radially spray a plurality of very low water-usage streams at a urinal receptacle interior surface to generate a widespread splatter-induced mist collectively providing a distributed misted spray volume within the urinal receptacle.

Preferably the sprinkler-related products shown incorporated into urinal-receptacle 30 of FIGS. 14, 16 and 17 are made coaxially installable within an emitter mount 204 of a receptacle drain 48, and the drain is equipped with one or more drain apertures (e.g., radially exterior to the outer diameter of the mount) communicating with a waste-liquid line, and a separate water line connected with one or more water-emitting elements of a sprinkler-related product. For example, as illustrated in FIGS. 16 and 17, the center of receptacle drain 48 is configured with a sprinkler mount 204 attachable with an upper end of a water line which includes a threaded opening or aperture sized to receive the lower threaded end of a sprinkler emitter 198 (shown adjacent to an upper end of a vertically elongated tube in FIG. 16, and adjacent to the receptacle drain 48 in FIG. 17).

Figure 15:
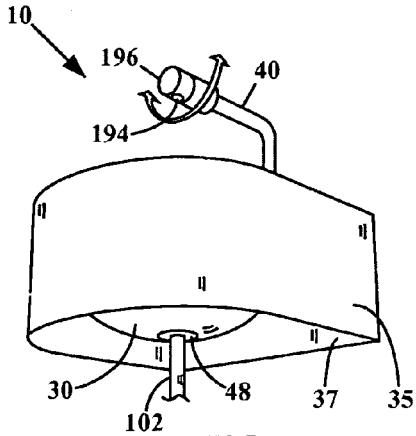
FIG. 15 is a three-dimensional view of a sprinkler-related product having a pivotable sprinkler head mounted to an end of an 'L-shaped' member extending outward and over a urinal receptacle, and configured with one or more very low water-usage nozzles transversely mounted on the rotational head at an angle which provides a distributed misted spray volume during pivoting of the head.

In reference to FIG. 15, a sprinkler-related product having a pivotable sprinkler head 196 is illustrated incorporated, above a urinal receptacle 30, at an upper outer end of a generally L-shaped member, for example configured as a mist-dispensing means 40, or equipped with one or more very low water-usage nozzles 194 transversely mounted on the rotational head at an angle which provides a distributed misted spray volume during a back and forth rotation of the head over a predetermined range, or degrees of arc.

In FIGS. 16 and 17 the sprinkler-related products incorporated into the urinals 10 are of a type made to radially emit multiple fine streams of water, in a very low water-usage manner, which collectively provide a widespread splatter-induced mist coverage over the urinal-receptacle surface 32 which, in turn, pre-conditions the receptacle surface prior to use and/or conditions the surface during a urinal use-cycle in a manner prohibiting waste liquid from being retained on the urinal-receptacle surface 32. To facilitate collection of emitted water within the bounds of a urinal receptacle, the receptacle may be equipped with a receptacle rim 172 or lip, having an overhang (into the receptacle) sufficiently sized to capture all emitted water within the receptacle. In FIG. 16 the emitter is configured adjoining an upper end of a fixed height, or positionable height, elongated tube so as to spray multiple streams radially outward (the emitted water is depicted in dashed and dotted lines) in a manner facilitating self-cleaning of the urinal receptacle surface 32. Similarly, in FIG. 17 the emitter is configured adjoining an upper end of an emitter mount 204 so as to spray multiple streams radially outward and upward in a manner facilitating self-cleaning of urinal receptacle surface 32.

Optionally, one or more nozzles or emitters incorporated into a sprinkler head can be configured with an adjacent overspray deflecting plate or member sized and shaped to restrict a mist, stream or spray of emitted water within the interior of the urinal receptacle.

Figure 18:
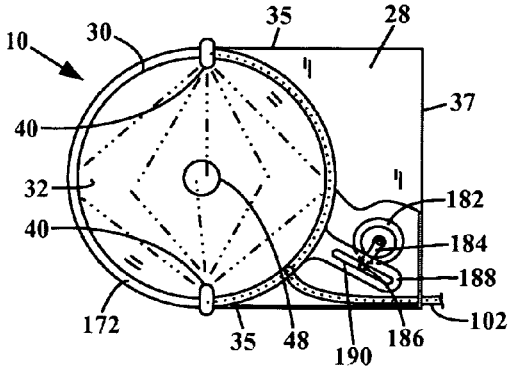
FIG. 18 is a two-dimensional top view of a positionable urinal equipped with a urinal receptacle rim incorporating a water conduit for supplying pressurized water to a plurality of misters configured rotatably positionable by powered mechanical actuating means to provide a distributed misted spray volume within the urinal receptacle.
Figure 19:
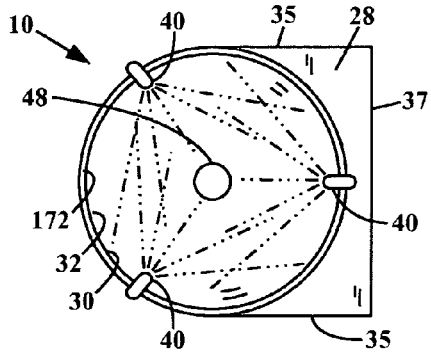
FIG. 19 is a two-dimensional top view of a positionable urinal and urinal receptacle rim incorporating a plurality of fixed misters which are collectively configured to provide a distributed misted spray volume within the urinal receptacle.

In reference to FIGS. 18 and 19, a plurality of sprinkler-related products such as mist or fog emitters or nozzles, are shown, each incorporated adjacent to a perimeter portion of a receptacle rim 172 and configured to collectively emit a widespread water mist or misted fog coverage over the urinal-receptacle surface 32 in a very low water-usage manner. Optionally the plurality of emitters or nozzles can be mounted in view (as shown), or mounted concealed from view e.g., underneath rim 172. In FIG. 18 receptacle rim 172 is configured positionably rotatable adjacent to an upper perimeter of urinal receptacle 30 with the plurality of emitters or nozzles attached to the rim, and illustrates how a smaller number of emitters or nozzles when made positionable can cover an area with a distributed misted spray volume that would otherwise require a greater number (or double the number). A portion of rim 172 is configured as a water conduit that is attached by suitable coupling means with an end of a flexible water line 102 having an extended length to accommodate the full positioning range of the rim. The water conduit is connected with, and provides pressurized water to, each of two mist or fog emitters, or nozzles, which collectively serve as positionable mist-dispensing means 40. Attached to a portion of rim 172 is a rim positioning arm 188 which is positionable by suitable coupling made with powered mechanical actuating means. For example, in FIG. 18 a lower right portion of the drawing is shown in partial cut-away view to depict a top view of actuating means operably configured within the interior of a casing of urinal 10, wherein the rim positioning arm 188 is equipped with an elongated slot 190 into which a slot positioning post 186 mounted on an outer end of a rotatable arm 184 positions arm 190 back and forth a predetermined number of degrees as a drive shaft of motor 182 attached to an opposite end of arm 184 is rotated by the motor. As rim 172 is positioned back and forth, for example during a use-cycle, the two emitters or nozzles each provide a mist spray that covers two adjacent quadrants (approximately half) of the urinal receptacle interior surface 32. Accordingly, during a use-cycle of one minute, two emitters or nozzles of a type that emit 1-2 gallons of water per hour ('GPH') would collectively use $1/60^{th}$ of 2-4 gallons (or $1/30^{th}$ of 1-2 gallons), or 4.4 to 8.8 ounces per minute, which is in a single-digit percent of water-usage compared with the 1 gallon per flush ('GPF') volume, of standard 'low water use' urinals in wide use today. FIG. 19 illustrates the alternative of configuring a receptacle rim 172 with a plurality of fixed emitters or nozzles, for example three 1 GPH spray or fog emitters or nozzles, which would collectively use 6.6 ounces of water during a one-minute use cycle. It is noted that the foregoing one-minute use-cycle timeframe is used for the purposes of illustration, as many typical urinal use-cycles are completed in well under a full minute, and that water control means of the present invention are configurable to turn water off immediately or shortly after a use cycle, accordingly further reductions in water-usage (proportionate to <one-minute use-cycles) are also achievable.

In the remaining drawing figures (FIGS. 20A through 27F), further illustrative details of urinals, urinal-related components or elements positionable by manual or powered mechanical actuating means (e.g., selectable from among those previously described) are provided. In the three-dimensional front views of FIGS. 20A through 21B and side views of FIGS. 22A and 22B, mist-dispensing means 40 of a fixed or positionable urinal are depicted positionable between reduced-profile states (in FIGS. 20A, 21A and 22A) and extended-profile states (in FIGS. 20B, 21B and 22B), with the span between the two states indicated by dashed lines and adjacent double arrow-heads, wherein a positioning to each extended-profile state provides a predetermined alignment between mist dispensing means 40 and urinal receptacle 30, which in turn provides a distributed misted spray volume.

Figure 20A:
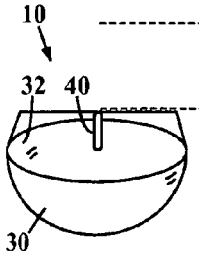
Figure 20B:
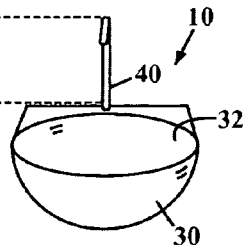
Figure 21A:
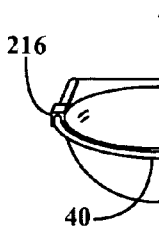
FIGS. 21A and 21B are three-dimensional front views of mist-dispensing means pivotally positionable, at a side of a urinal receptacle, between reduced-profile and extended-profile states (FIGS. 21A and 21B respectively), wherein alignment of the extended-profile state facilitates a dispensing of a distributed misted spray volume within the urinal receptacle.
Figure 21B:
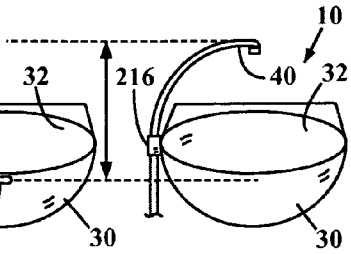
Figure 22A:
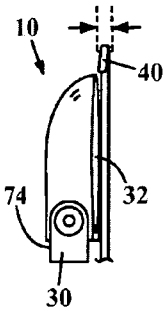
FIGS. 22A and 22B are three-dimensional side views of a pivotally positionable urinal receptacle, and mist-dispensing means, near the urinal receptacle, pivotally positionable between reduced-profile and extended-profile states (FIGS. 22A and 22B respectively), wherein the extended-profile state facilitates a dispensing of a distributed misted spray volume within the urinal receptacle.
Figure 22B:
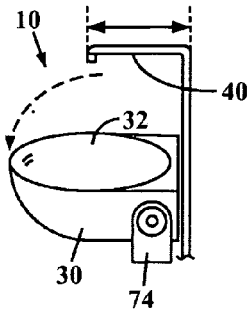

In FIGS. 20A and 20B mist-dispensing means 40 of a fixed or positionable urinal is configured slidably positionable between reduced-profile and extended-profile states along a vertical axis. For example, the outer diameter ('O.D.') of a vertical tube portion (of means 40) can be configured to slidably operate within an inner diameter ('I.D.') opening of one or more collars, tubes or apertures, or the like, associated with a casing of a urinal 10 or other structural member adjacent, proximate or near to the urinal. In FIGS. 21A and 21B mist-dispensing 40 of a fixed or positionable urinal is shown pivotally positionable between reduced-profile and extended-profile states about a transverse axis. In FIGS. 22A and 22B urinal receptacle 30 and mist-dispensing 40 are each shown pivotally positionable between reduced-profile and extended-profile states, wherein the mist-dispensing means is pivotally positionable about a vertical axis (separate from the urinal), and urinal receptacle 30 is pivotally positionable about a transverse axis e.g., of a U-shaped mounting bracket 74 pivotally attached to opposite sides of urinal 10 or urinal receptacle 30.

Figure 23A:
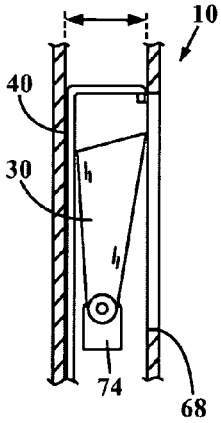
FIGS. 23A and 23B are two-dimensional cut-away side views of a fixed mist-dispensing means mounted in a wall adjacent to a urinal receptacle expandable in depth from a reduced-profile (zero-footprint) state to an extended-profile state (FIGS. 22A and 22B respectively) wherein the extended-profile state provides urinal receptacle alignment with the fixed mist-dispensing means which facilitates a dispensing of a distributed misted spray volume within the urinal receptacle.
Figure 23B:
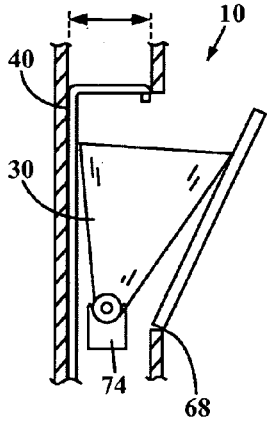

In the two-dimensional side views of FIGS. 23A and 23B mist-dispensing 40 is shown in a fixed configuration e.g., within an interior portion of a wall, and urinal receptacle 30 (optionally supported by a mounting bracket 74) is made of a flexible, stretchable, or expandable and contractible material, such that, an attachment made between at least some of the receptacle and a positionable panel 76, and a positioning of the panel to an extended-profile state, provides a predetermined alignment between urinal receptacle 30 and mist dispensing means 40, which in turn provides a distributed misted spray volume.

Figure 24A:
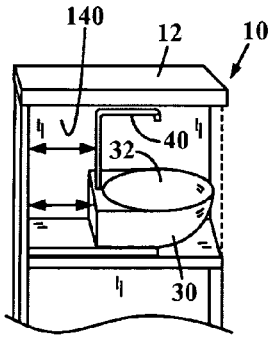
FIGS. 24A and 24B are three-dimensional cut-away side views of a urinal and mist-dispensing means configured slidably positionable in concert between a concealed, zero-footprint state (FIG. 24A) and a revealed-for-use state (FIG. 24B) wherein alignment between the urinal receptacle and mist-dispensing means facilitates a dispensing of a distributed misted spray volume within the urinal receptacle.
Figure 24B:
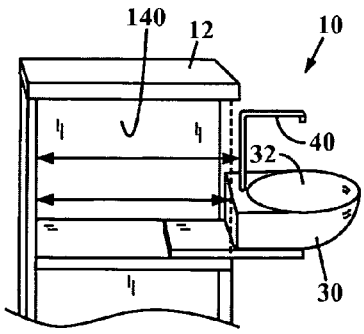
Figure 24C:
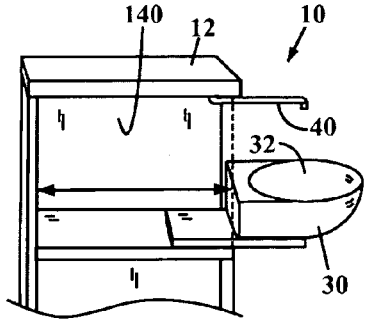

FIGS. 24A through 24C are three-dimensional cut-away side views showing a urinal 10 slidably positionable out from and into an interior volume 140 of custom cabinetry 12. In FIGS. 24A and 24B mist-dispensing 40 is shown in a fixed configuration mounted adjacent to an upper opening of urinal receptacle 30, such that the urinal and mist-dispensing means 40 are positioned in concert (indicated by the two double arrow-headed lines in each of the figures). In FIG. 24C mist-dispensing 40 is configured pivotally mounted adjacent to a bottom side of a top (e.g., a countertop) of customary cabinetry 12 and through suitable coupling and/or linkage with a positionable panel or other positionable member (not shown) is positionable between a reduced-profile and extended-profile states, such that urinal receptacle 30 and urinal-receptacle interior surface 32 are slidably positionable into alignment with the mist-dispensing means 40.

Figure 25A:
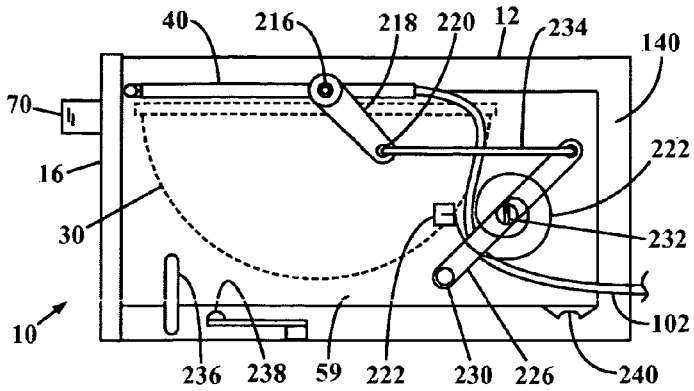
FIGS. 25A, 25B and 25C, and 26A, 26B and 26C are two-dimensional cut-away side views illustrating apparatus configured to position mist-dispensing means in response to a user manually positioning a drawer, or drawer-like structure.
Figure 25B:
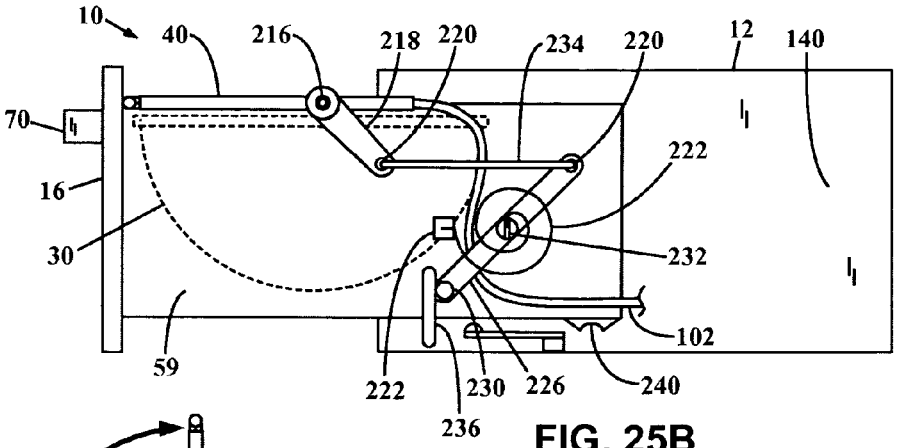
Figure 25C:
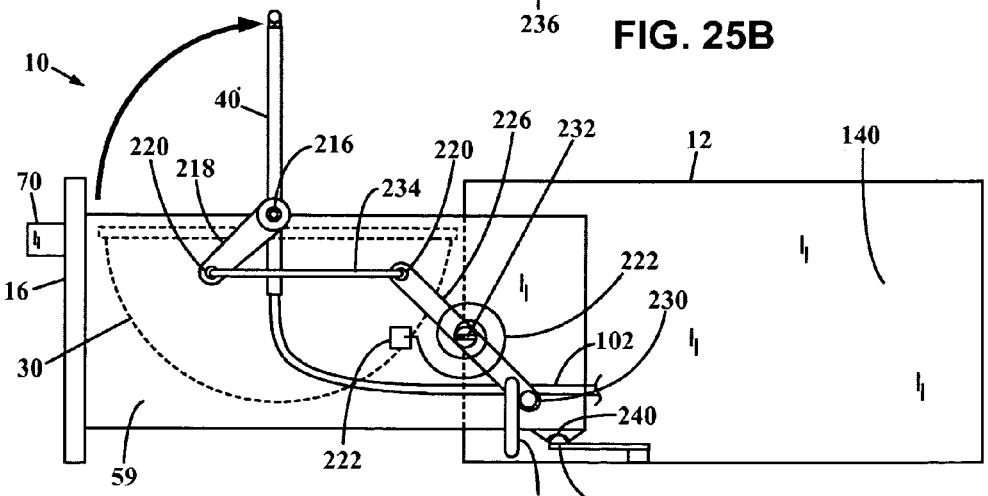
Figure 26A:
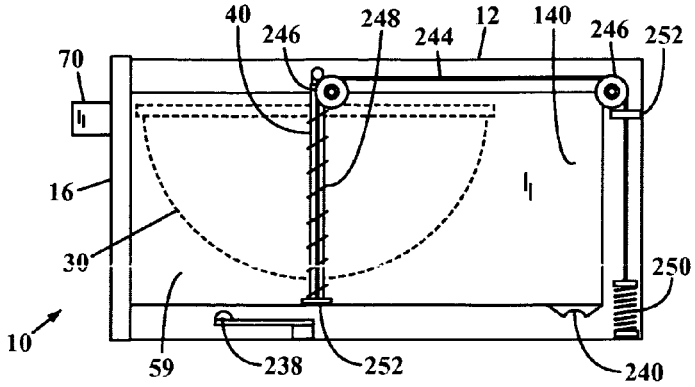

The cut-away side views of FIGS. 25A-25C and 26A-26C illustrate examples of manual positioning means configured, in response to a user positioning of a positionable panel, to pivotally or slidably move mist-dispensing means between reduced-profile and extended-profile states. In FIGS. 25A and 26A a drawer (or drawer-like structure) is shown in a closed state. In FIGS. 25B and 26B, and 25C and 26C the drawers (or drawer-like structures) are shown in partially and fully opened states respectively.

In FIGS. 25A-25C mist-dispensing means 40, attached with an end of a flexible water line 102, is shown being pivotally attached at a transverse pivot mount 216 (e.g., adjacent to a side of a urinal receptacle 30) and having a pivot arm 218 with an aperture 220 pivotally engaged by an end of a connecting rod 234 which in turn is pivotally engaged at an opposite end with an aperture of a swivel arm 226 rotatably mounted to a drawer side 59 of a drawer (or drawer-like structure) equipped with a urinal 10 whereby the latter is slidably operable out from and into an interior volume 140 of customary cabinetry 12 (the positioning means are not necessarily depicted in scale). Swivel arm 226 is rotatably attached to drawer side 59 and is shown being equipped with return means, such as a spring retainer 232 which secures a first end of a spiral spring 224, and a spring mount 222 attached to drawer side 59 which secures an opposite end of the spiral spring. Swivel arm 226 is also equipped with a swivel arm post 230 which extends outwardly to engage a side of a post-travel stop 236 mounted to an internal surface of customary cabinetry 12. In operation, a user manually pulls outwardly on a handle 70 of a partial cabinet-height positionable panel 16 to move the drawer from a closed position (FIG. 25A) to a partially opened position (FIG. 25B) until swivel arm post 230 contacts post-travel stop 236. As the drawer is then moved outward to a fully opened position (FIG. 25C), post-travel stop 236 contact with swivel arm post 230 causes swivel arm 226 and an inner portion of the spiral spring to rotate counter-clockwise, which in turn, causes connecting rod 234 to rotate pivot arm 218 and its associated mist-dispensing means 40 clockwise (from a reduced-profile state to an extended-profile state). Preferably the drawer or drawer-like structure is equipped with a drawer retainer, such as a spring-loaded drawer-travel stop 238 which engages a drawer-stop indent 240 under a sufficient spring load to retain the drawer in a fully opened position. Following a use-cycle a user manually moves the drawer inwardly which allows the compressed spiral spring to rotate swivel aim 226 clockwise and connecting rod 234 to rotate pivot aim 218 and its associated mist-dispensing means 40 counter-clockwise (from an extended-profile state to a reduced-profile state).

Figure 26B:
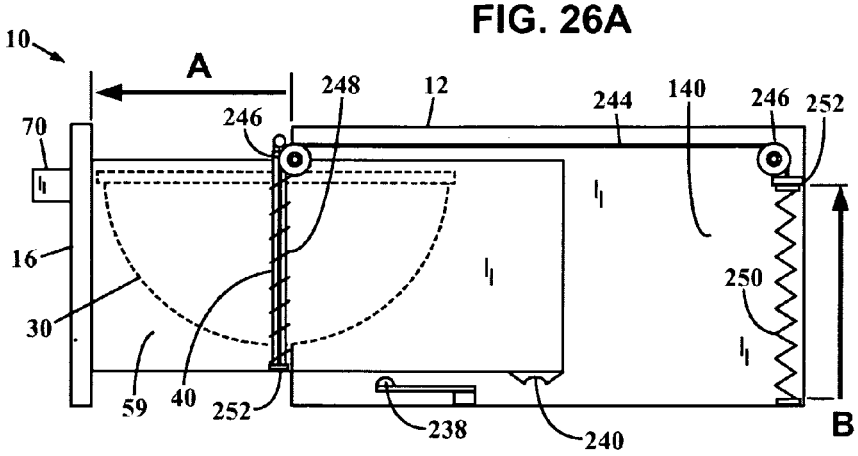
Figure 26C:
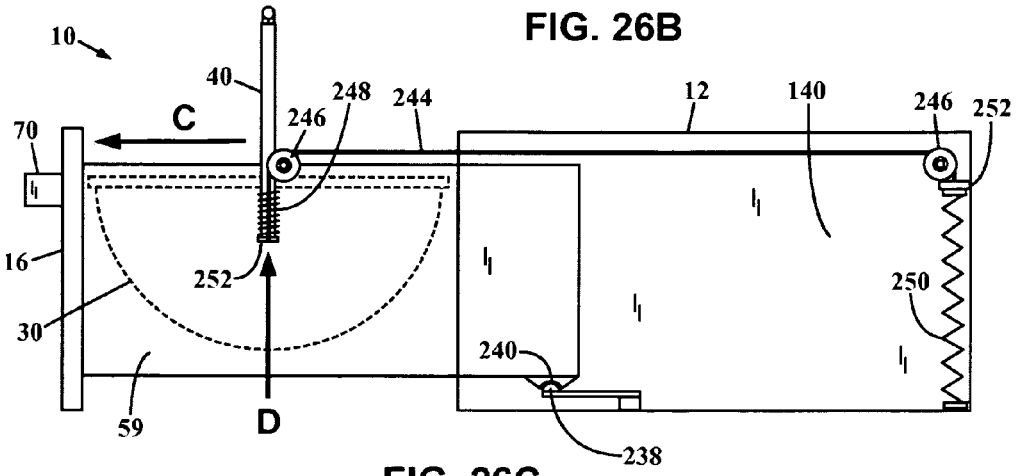

In FIGS. 26A-26C mist-dispensing means 40 (water line not shown) is depicted slidably mounted in a vertical axis e.g., adjacent to a side of a urinal receptacle 30, within a vertically aligned normally-expanded spring 248. A first end of a cable 244 (cord or line) is attached at a lower end of the spring to a vertically positionable travel stop 252 attached near the bottom of mist-dispensing means 40, and an opposite end of the cable is attached to an upper end of a normally-contracted spring 250. The normally-contracted spring 250 is configured as a cable return means (when the drawer is being closed) and thus can be made having much less spring resistance than normally-expanded spring 248. The cable is supported by two pulleys 246, a forward pulley mounted adjacent to a side of a urinal receptacle 30, and a rear pulley mounted adjacent to a side 59 of an interior volume 140 of customary cabinetry 12 (the positioning means are not necessarily depicted in scale). In operation, a user manually pulls outwardly on a handle 70 of a partial cabinet-height positionable panel 16 to move the drawer from a closed position (of FIG. 26A) to a partially opened position (of FIG. 26B) the span indicated by horizontal arrow "A," until the upper end of normally-contracted spring 250 is pulled upward by cable 244 (to spring expanded length, indicated by arrow "B") contacting rear travel stop 252, which prohibits any further movement of the rear end of the cable. As the drawer is then moved outward from partially opened position (of FIG. 26B) to a fully opened position (of FIG. 26C) the span indicated by horizontal arrow "C," the first end of cable 244 pulls upwardly on vertically positionable travel stop 252 attached to mist-dispensing means 40 contracting normally-expanded spring 248 (to a spring contracted state indicated above arrow "D") and moving means 40 vertically upward from a reduced-profile state to an extended-profile state). Preferably the drawer or drawer-like structure is equipped with a drawer retainer, such as a spring-loaded drawer-travel stop 238 which engages a drawer-stop indent under a sufficient spring load to retain the drawer in a fully opened position during a use-cycle. Following a use-cycle a user manually moves the drawer inwardly, overcoming the drawer stop, and reversing the previously described movements C and D, which initiates a moving of means 40 vertically downward from an extended-profile state to a reduced-profile state by allowing normally-expanded spring 248 to expand. As the drawer is positioned from a partially opened position (of FIG. 26B) to a fully closed position (of FIG. 26A), previously described movements A and B are reversed and normally-contracted spring 250 retracts (or takes up any slack in) the rear end of cable 244.

While the operational descriptions pertaining to FIGS. 25A-25C and 26A-26C have been described in terms of a manual positioning of the drawers (or drawer-like structures) and their respective mist-dispensing means 40, it is noted that the same apparatus may alternatively be positioned by powered mechanical actuating means.

For example, for the purposes of illustration, and not to be construed as a limiting of the scope of the invention, several simplified profile or side view examples of partial cabinet-height drawers, each slidably mounted in customary cabinetry 12 and configured with powered mechanical actuating means, are provided in FIGS. 27A through 27F. For the purposes of simplifying the illustrations the aforementioned control means, such as manually operated switches, buttons, valves, or automatically controlled sensing and switching apparatus, valve control, wiring and the like, are generally not shown, but it is understood that any of such can readily be installed conventionally in accordance with any among a variety of common practices. Accordingly, the following descriptions of powered mechanical actuating means (not necessarily depicted in scale), assume that each of such means are configured responsive to manual and/or automatic switching as needed or desired.

Figure 27B:
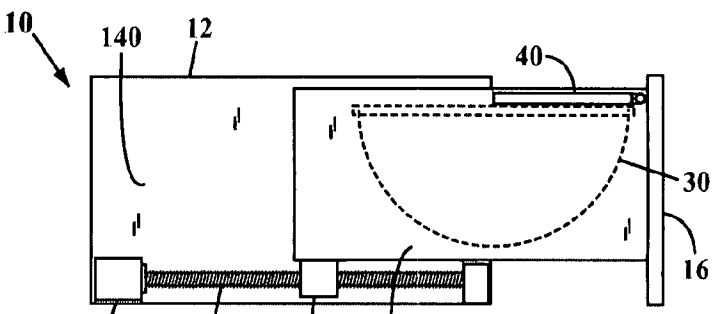
FIGS. 27A through 27F are two-dimensional cut-away side views illustrating powered mechanical actuating means configured to position a drawer, or drawer-like structure, a urinal and mist-dispensing means, between a concealed, zero-footprint state and an extended-for-use state. Each of the drawers is shown in a partially opened state.
Figure 27A:
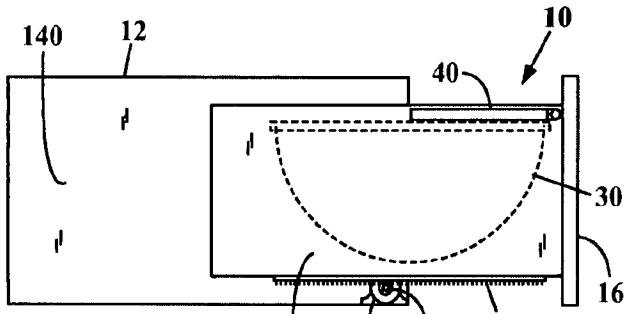

In FIG. 27A powered mechanical actuating means comprises a rack and pinion, and motor arrangement, wherein a rack gear 254 is attached to a lower portion of a slidably positionable drawer, or drawer-like structure (hereinafter referred to as a 'drawer') which supports a urinal 10. The rack gear, drawer, urinal and mist-dispensing means 40 are collectively positionable into, and out from, an interior volume 140 of customary cabinetry 12 by a rotating of a pinion gear 256 configured to engage the rack gear and mounted on the end of a driveshaft of a controllable electric motor 181. The motor is configured reversible by a switching of the polarity of DC voltage supplied to the motor at the end of each predetermined outward or inward range of movement (or cycle). Preferably limit switching is also provided to limit the range of drawer movement within the predetermined outward and inward range.

Alternatively any of the embodiments employing an electric motor, stepper motor or servo can be equipped with motor control means comprising an electrically powered circuit board and micro-controller (or other processor configured to read a machine code language) responsive to a programmed digital memory or instructions, to control the moving of one or more positionable components within a predetermined and limited range e.g., by a number of steps, or a duration of motor rotation and counter-rotation, and the like. Additionally or optionally, the programmable digital memory may also include acceleration and deceleration profiles readable by the micro-controller when it is advantageous to include such profiles.

In FIG. 27B powered mechanical actuating means comprises a lead screw, screw follower and motor arrangement is provided, wherein a screw follower 286 is attached to a lower portion of a slidably positionable drawer which supports a urinal 10. The screw follower, drawer, urinal and mist-dispensing means 40 are collectively positionable into, and out from, an interior volume 140 of customary cabinetry 12 by rotation of a lead screw 258 mounted on a first end to a driveshaft of a controllable electric motor 181 and supported on an opposite end by suitable lead screw support means mounted on interior volume 140 surface of customary cabinetry 12 such as a bearing-mount.

Figure 27D:
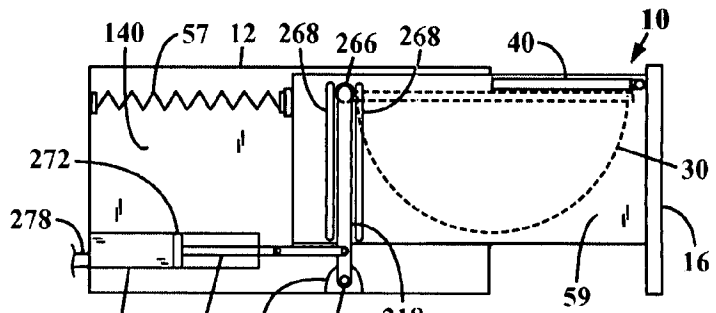
Figure 27C:
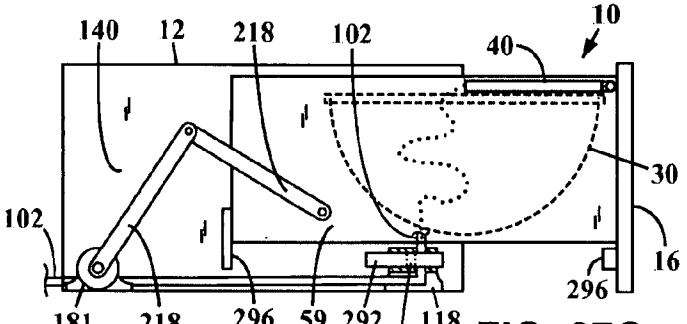

In FIG. 27C powered mechanical actuating means comprises a positionable control arm assembly and motor arrangement, wherein a forward end of the control arm assembly 218 is pivotally attached to a drawer side 59 of a slidably positionable drawer configured to support a urinal 10. The drawer, urinal and mist-dispensing means 40 are collectively positionable into, and out from, an interior volume 140 of customary cabinetry 12 by rotation of a driveshaft of a controllable electric motor 181 mounted on a surface of interior volume 140 of customary cabinetry 12. For example, a first motor rotation is employable to move the control arm elements toward a horizontal orientation, which in turn, extends the drawer, urinal and mist-dispensing means outwardly; and, an opposite motor rotation is employable to move control arm elements toward a vertical orientation, which retracts the slidably positionable components into the interior volume 140 of the customary cabinetry 12.

To illustrate the principle of automating the control of pressurized water provided to mist-dispensing means 40 in response to a positioning of one or more positionable components, FIG. 27C provides a simplified depiction of a valve 118 mounted on a surface of an interior volume 140 of customary cabinetry 12 and configured to control pressurized water provided by a water line 102. A curved dotted line connected between an upward-extending end of water line 102 and a water-receiving end of mist-dispensing means 40 represents a length of flexible water conduit sufficient to accommodate the full positioning of the positionable drawer. Valve 118 is shown having a slidable valve plunger 292 which is bi-directionally positionable by contact made with a movable contacting surface of a positionable member, such as a surface of either plunger positioner 296. The slidable valve plunger 292 is shown equipped with a vertical transverse channel 294 which, in response to a positioning by a plunger positioner 296 in a first direction is positionable into alignment with water line 102 to provide pressurized water to mist-dispensing means 40, and in response to a positioning by a plunger positioner 296 in a opposite direction is positionable out of alignment with the water line to turn off the water supplied to the mist-dispensing means. While the valve positioning illustrated in FIG. 27C is depicted as being slidable, it is noted that various other valve positioning approaches are possible and can alternatively be incorporated to automate the control of pressurized water, or air, in response to a positioning of one or more positionable components. For example, a valve may be equipped with a controllable switch or lever which can be positioned bi-directionally in a manner similar to that just described, or a valve may be equipped with a rotatable control member which can be positioned bi-directionally by applying (or capturing) rotational or pivotal positioning of one or more positionable components, and the like.

In FIG. 27D powered mechanical actuating means comprises a pneumatically or hydraulically positionable control arm assembly arrangement, wherein an upwardly extending arm of a control arm assembly 218 is pivotally attached to a pivot mount 264 on a horizontal surface of an interior volume 140 of customary cabinetry 12. An upper end of a vertical member of the control arm assembly is equipped with a pivot arm post 266 which extends into, and is slidably operable within, a vertical slot formed by two parallel post-slot walls 268 mounted on, formed on, or attached to a drawer side 59 of a slidably positionable drawer configured to support a urinal 10. The drawer, urinal and mist-dispensing means 40 are collectively positionable into, and out from, an interior volume 140 of customary cabinetry 12 by powered mechanical actuating means, which includes a connecting rod 270 extending through an open end of, and attached at a rear end to an outer side of a piston 272 which is slidably operable within, a pneumatic or hydraulic actuator cylinder 276 having an air or water inlet 278 equipped to receive a controllable supply of pressurized air (as a pneumatic actuator) or water (as a hydraulic actuator). As previously described, mist-dispensing means 40 (when not configured in a fixed orientation adjacent to or near a urinal receptacle 30), are positionable between reduced-profile and extended-profile states by the employment of any one or more among the aforementioned mist-dispensing means positioning apparatus or mechanisms. Preferably return means are also provided, such as return spring 57, to facilitate a returning of the drawer, urinal and mist-dispensing means within interior volume 140 following a use-cycle. In operation, a use-cycle begins with the drawer, urinal and mist-dispensing means located within interior volume 140, and piston 272 in a rearmost position near inlet 278. In response to the actuator receiving a controllable pressurized supply of air or water conducted through air or water inlet 278, the piston is slidably positioned away from the inlet which transfers horizontal movement through connecting rod 170 to the vertical member of the control arm assembly 218 (pivotably mounted via a pivot arm aperture 220 to pivot mount 264) such that the pivot arm post 266 extending into, and slidably operable between post slot walls 268 simultaneously positions the drawer outward in response (or proportion) to the movement of the piston. At the end of a use-cycle, switching means configurable to shut off the pressurized air or water supply (e.g., a valve controllable as previously described) and to release or reduce pressure within the actuator cylinder can be enabled (not shown). For example, the actuator cylinder can be equipped with a controllable pressure-relief valve, or equipped with a valve mounted adjacent to a rear portion of the cylinder which when opened, utilizes any remaining or residual water pressure water by conducting it to mist-dispensing means 40 during a post use-cycle or flushing phase. As the pressurized air or water is sufficiently reduced, return means e.g., return spring 57, draws the drawer, urinal and mist-dispensing means 40 collectively into interior volume 140 of customary cabinetry 12. When the actuator is configured for operation pneumatically, it is noted that a pressurized air supply that is highest at the beginning of a use-cycle and lowest subsequent to a use-cycle may optionally be derived by a coupling of an air conduit or tube to an air outlet mounted on, or formed at an upper end of a nearby standpipe.

Figure 27F:
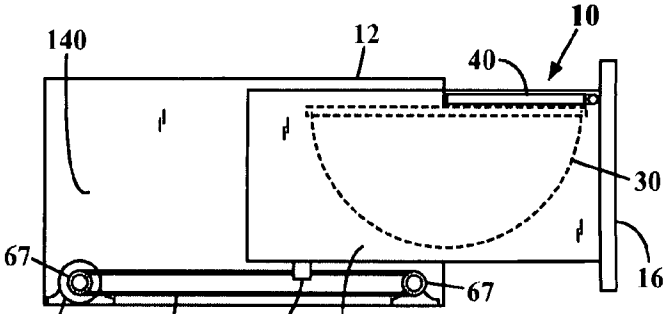
Figure 27E:
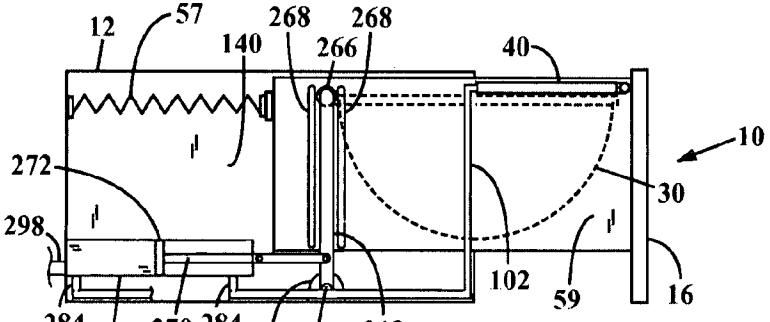

In an arrangement similar to that depicted in FIG. 27D, the powered mechanical actuating means of FIG. 27E comprises a hydraulically positionable control arm assembly arrangement and positioning components or elements that are structurally and operationally the same as FIG. 27D except for a hydraulic actuator and valve 282, which is configured structurally and operationally as an actuator-valve cylinder having one or more valve water outlets 284 along the length of the cylinder, configured to conduct water to mist-dispensing means via water line 102 when the position of piston 272 reaches a predetermined point. For example, as configured in FIG. 27E, the water valve outlet 284 shown furthest from water inlet 298 would only receive pressurized water when piston 272 was positioned (by controllable water pressure) to the right of the outlet, after the drawer was positioned entirely (or partially) and after, or as, mist-dispensing means 40 is positioned from a reduced-profile state to an extended-profile state aligned with urinal receptacle 30 to provide a distributed misted spray volume. Accordingly, the actuator-valve cylinder is configurable to earlier provide a given or predetermined drawer movement and then supply pressurized water at an optimal positioning of the drawer and/or mist-dispensing means. At the end of a use-cycle, switching means configurable to: shut off the pressurized water supply (e.g., by a valve controllable as previously described) such that no additional water is conducted into the actuator-valve cylinder; and, release or reduce water pressure within the actuator cylinder can be enabled (not shown). For example, the actuator-valve cylinder can be equipped with a controllable pressure-relief valve, or equipped with a valve mounted adjacent to a rear portion of the cylinder (e.g., controlling water at the valve water outlet 284 nearest water inlet 298) which when opened, utilizes any remaining or residual water pressure water by conducting it to mist-dispensing means 40 during a post use-cycle or flushing phase. As the pressurized water is sufficiently reduced, return means e.g., return spring 57, draws the drawer, urinal and mist-dispensing means 40 collectively into interior volume 140 of customary cabinetry 12. It is noted that water line 102, while being shown having angular bends, can alternatively include one or more portions that are comprised of a flexible tube material having an overall length sufficient to accommodate the full range of movement of the drawer.

In FIG. 27F powered mechanical actuating means comprises a motor, pulleys and belt arrangement (or motor, sprockets and chain) configured to provide a positioning of a drawer (and associated components) in relation to customary cabinetry 12. For example, in FIG. 27F a belt 288 is shown rotatably mounted around two pulleys 67: a first pulley 67 is rotatably mounted to a driveshaft of a controllable motor 181; and a second pulley is configured as a freely-rotatable idler shown on a mounting to a horizontal surface of an interior volume 140 of customary cabinetry 12. Attached to the belt is a belt positionable member 290, which in turn, is attached to a lower portion of a slidably positionable drawer which supports a urinal 10. The rack gear, drawer, urinal and mist-dispensing means 40 are collectively positionable into, and out from, an interior volume 140 of customary cabinetry 12 by a rotating of the first pulley 67 with controllable electric motor 181. The motor is configured reversible by a switching of the polarity of DC voltage supplied to the motor at the end of each predetermined outward or inward range of movement (or cycle). Preferably limit switching is also provided to limit the range of drawer movement within the predetermined outward and inward range.

While the descriptions of FIGS. 25A through 27F pertaining to manual, and powered mechanical actuating means, for positioning one or more positionable components of the present invention have been made in reference to a drawer slidably positionable into and out from an interior volume of customary cabinetry, it is noted that any one or more of such means can instead be employed with positionable urinals and/or mist-dispensing means associated with a pivotally positionable door, or door-like member. Similarly, any of the foregoing descriptions pertaining to the manual operation, or automated operation, of one or more valves, and made in reference to a slidably positionable drawer into and out from an interior volume of customary cabinetry, are alternatively employable with positionable urinals and/or mist-dispensing means associated with a pivotally positionable door, or door-like member.

Accordingly, a method and apparatus for substantially reducing water-usage by employment of very low water-usage mist-dispensing means separately positionable from, or positionable in concert with, a urinal configured concealable within and extendable from customary cabinetry of a room, or a wall, is provided.

Although the present invention and its advantages have been described in detail, those skilled in the art should understand that they can make various changes, substitutions and alterations herein without departing from the spirit and scope of the invention in its broadest form.

The invention claimed is:

1. A positionable, zero-footprint self-cleaning urinal and very low water-usage mist-dispensing means apparatus, comprising:

a self-rinsing urinal and very low water-usage mist-dispensing means mountable in close proximity to a normally-interior portion of at least one positionable panel, the panel(s) configured slidably or pivotally positionable from an opening of customary cabinetry of a room or a building-code compliant wall, from which, the urinal is positionable between a zero-footprint concealed state and a revealed-for-use state, wherein an interior receptacle surface of the urinal is aligned with said very low water-usage mist-dispensing means during at least said revealed-for-use state, to receive from said mist-dispensing means a distributed misted spray aligned with the receptacle to repel waste-liquid from and facilitate a self-rinsing of the receptacle while employing as little as single-digit ounce(s) of water, per use-cycle;

said very low water-usage mist-dispensing means coupled at a water-receiving end to a water conduit equipped to convey a pressurized, valve controllable supply of water;

said urinal receptacle equipped with at least one drain coupled to a waste-fluid conduit equipped to convey waste-fluid away from the urinal receptacle; and at least a portion of said water conduit or said waste-fluid conduit, or both, configured with a flexible material or a pivot coupling to accommodate repeated positionings of the urinal.

2. The apparatus according to claim 1, further comprising said customary cabinetry consisting of the type incorporating one or more plumbing fixtures equipped to be plumbed in a typical manner;

a water-receiving end of said mist-dispensing means water conduit configured to receive water from a water supplying conduit of at least one of said one or more plumbing fixtures of said customary cabinetry, and, a portion of a drainage line of a plumbing fixture of said customary cabinetry equipped to receive end portion of said urinal waste-fluid conduit for the conveyance of waste-fluid into said drainage line.

3. The apparatus according to claim 1, further comprising mechanical linkage operatively connecting said very low water-usage mist-dispensing means and the positionable panel, wherein said mechanical linkage is configured, in response to a moving of the positionable panel from a zero-footprint closed state to an opened state, to position mist-dispensing means from a reduced-profile state interiorly storable within said cabinetry or wall to an extended-profile state aligned to dispense said distributed misted spray volume, following a outward first positioning of the urinal receptacle to a predetermined degree; and following a use-cycle, said mechanical linkage is configured in response to a moving of the positionable panel from an opened state to a closed state, to position mist-dispensing means from said extended-profile state to said reduced-profile state interiorly storable within said cabinetry or wall during an inward second positioning of the urinal receptacle to a predetermined degree.

4. The apparatus according to claim 1, wherein said at least one positionable panel is configured positionable to align an interior fluid-capturing surface of a receptacle of said urinal separately from, and into alignment with, said mist-dispensing means.

5. The apparatus according to claim 1, further comprising mechanical linkage operatively connecting said very low water-usage mist-dispensing means and an actuating means whereby said mist-dispensing means are made independently positionable.

6. The apparatus according to claim 1, further comprising a two-stage hydraulic piston-valve actuator operatively coupled to said very low water-usage mist-dispensing means and said at least one positionable panel; wherein during a first stage, an actuator arm pivotally attached to an outer end of a piston operable within a chamber of the piston-valve actuator, is configured to position said positionable panel(s) from a zero-footprint closed state to an opened state, and following an outward initial positioning of the urinal receptacle to a predetermined degree, configured to position said mist-dispensing means from a reduced-profile state interiorly storable within said cabinetry or wall to an extended-profile state aligned to dispense said distributed misted spray volume into said receptacle when the panel(s) is positioned in a revealed-for-use state; and during a second-stage, a water outlet passing through a side of said chamber is passed by the piston causing pressurized water to flow out of said water outlet to said mist-dispensing means; and following a use-cycle, said mechanical linkage is configured, in response to a moving of the positionable panel from an opened state to a closed state, to position the aligned mist-dispensing means from said extended-profile state to said reduced-profile state interiorly storable within said cabinetry or wall during an initial inward second positioning of the urinal receptacle to a predetermined degree.

7. The apparatus according to claim 6, further comprising one or more springs operatively coupled to said at least one panel to facilitate a returning of the panel to a closed state, the mist-dispensing means to a reduced-profile state interiorly storable within said cabinetry or wall, and the piston to a position prior to said water outlet causing the pressurized supply of water to be shut off.

8. The apparatus according to claim 1, further comprising mechanical positioning means operatively connecting said very low water-usage mist-dispensing means and a positionable panel, wherein, a moving of the positionable panel from a zero-footprint closed state to an opened state correspondingly moves the mist-dispensing means from a zero-footprint state into a mist-dispensing state providing operative alignment between said distributed misted spray and said interior urinal-receptacle surface; and, a returning of the positionable panel to said zero-footprint closed state correspondingly moves the mist-dispensing means to said zero-footprint state.

9. The apparatus according to claim 1, further comprising said mist-dispensing means configured positionable responsive to positionings made to said positionable panel, via mechanical linkage operatively connecting said very low water-usage mist-dispensing means and the positionable panel, providing an operative alignment between said urinal receptacle fluid-capturing surface and said distributed misted spray during at least said revealed-for-use state.

10. The apparatus according to claim 1, wherein said mist-dispensing means are comprised of one or more mister nozzles.

11. The apparatus according to claim 10, wherein said mist-dispensing means include one or more positionable mister nozzles.

12. The apparatus according to claim 1, wherein said mist-dispensing means are comprised of one or more mist-spray emitters.

13. The apparatus according to claim 12, wherein said mist-dispensing means are comprised of one or more positionable mist-spray emitters.

14. The apparatus according to claim 4, further comprising said positionable panel configured manually positionable by a user, wherein a manual positioning of the positionable panel causes a corresponding positioning, via said mechanical linkage, of the mist-dispensing means.

15. The apparatus according to claim 1, further comprising a urinal receptacle made of a flexible material.

16. The apparatus according to claim 1, further comprising at least a urinal receptacle made of a transparent or semi-transparent material.

17. The apparatus according to claim 1, further comprising controllable lighting means configured, when turned on, to illuminate some or all of said urinal.

18. The apparatus according to claim 1, further comprising at least a fluid-capturing surface of a urinal receptacle having a hydrophobic property.

19. The apparatus according to claim 1, further comprising said mist-dispensing means configured linearly or pivotally positionable, or both, between reduced-profile and extended-profile states, whereby said mist-dispensing means are positioned to a reduced-profile state retainable with said urinal interiorly within said wall or cabinetry behind said positionable panel when the panel is moved to said normally-closed position; and, said mist-dispensing means are positioned to an extended-profile state extending above the positionable panel when the panel is moved to an opened position.

20. The apparatus according to claim 7, wherein said powered actuating means comprises at least one of: an electro-mechanical actuator, a computer or micro-processor controllable actuator, a linear actuator, a motorized control-arm actuator, a motorized pulley and belt actuator, a motorized pinion and rack actuator, a motorized lead-screw and follower actuator, a hydraulic actuator, a hydraulic piston-valve actuator, a pneumatic actuator.

21. The apparatus according to claim 7, wherein said control signal is received from at least one of: a manually operated switch, a foot-operated switch, a motion-sensitive sensor, a light-sensitive sensor, a temperature-sensitive sensor, a sound-sensitive sensor, a device equipped to communicate a control signal in response to a voice command or a programmable voice command, a computer or microprocessor, a predetermined or programmable timer, a pay-per-use apparatus in response to a payment, a wireless handheld device, a cell phone, a remote control device.

22. The apparatus according to claim 1, further comprising said urinal being pivotally mounted having a urinal receptacle equipped with a double drain arrangement, wherein in a first drain mode, a receptacle bottom-located drain outlet conveys waste-fluid from the receptacle during a use-cycle when the receptacle is in a revealed-for-use position; and, in a second drain mode, following the use-cycle, the urinal receptacle is pivoted approximately 90° to an upright reduced-profile position to be concealably stored, wherein a receptacle side-located drain outlet conveys waste-fluid from a then-lowest portion of the receptacle.

23. The apparatus according to claim 1, further comprising said mist-dispensing means equipped to provide a predetermined degree of rinsing following a use-cycle.

24. A positionable, zero-footprint concealable, self-cleaning urinal and very low water-usage mist-dispensing means, comprising:

a zero-footprint concealable and selectively revealable-for-use urinal configured positionable in concert with, or in relative alignment with, very low water-usage mist-dispensing means, to receive during at least a revealed-for-use state, a pre-wetting then distributed misted spray aligned with a urinal receptacle interior fluid-capturing surface, to repel waste-liquid therefrom, and facilitate a self-cleaning of the positionable urinal while employing as little as single-digit ounce(s) of water, per use-cycle;

a portion of said urinal mountable in proximity to an interior side of a door-like positionable panel, the panel configured pivotally mounted adjacent to an opening of a wall or an opening of customary cabinetry of a room, whereby said urinal and said mist-dispensing means are positionably concealed in a zero-footprint manner interiorly within the wall or the cabinetry when said positionable panel is in a normally-closed position, and at least a receptacle portion of the urinal is extended exteriorly out from the wall or the cabinetry in alignment with said distributed misted spray when said positionable panel is in an opened position;

said very low water-usage mist-dispensing means coupled at a water-receiving end to a water conduit equipped to convey a pressurized, valve controllable supply of water;

said urinal receptacle equipped with at least one drain coupled to a waste-fluid conduit equipped to convey waste-fluid away from the urinal receptacle; and at least a portion of said water conduit or said waste-fluid conduit, or both, configured with a flexible material or a pivot coupling to accommodate repeated positionings of the urinal.

25. A positionable, zero-footprint concealable, self-cleaning urinal and very low water-usage mist-dispensing means, comprising:

a zero-footprint concealable and selectively revealable-for-use urinal configured positionable in concert with, or in relative alignment with, very low water-usage mist-dispensing means, to receive during at least a revealed-for-use state, a pre-wetting then distributed misted spray aligned with a urinal receptacle interior fluid-capturing surface, to repel waste-liquid therefrom, and facilitate a self-cleaning of the positionable urinal while employing as little as single-digit ounce(s) of water, per use-cycle;

a portion of said urinal mountable in proximity to an interior side of a drawer-like positionable panel, the panel configured slidably operable from an opening of a wall or an opening of customary cabinetry of a room, whereby said urinal and said mist-dispensing means are positionably concealed in a zero-footprint manner interiorly within the wall or the cabinetry when said positionable panel is in a normally-closed position, and at least a receptacle portion of the urinal is extended exteriorly out from the wall or the cabinetry in alignment with said distributed misted spray when said positionable panel is in an opened position;

said very low water-usage mist-dispensing means coupled at a water-receiving end to a water conduit equipped to convey a pressurized, valve controllable supply of water;

said urinal receptacle equipped with at least one drain coupled to a waste-fluid conduit equipped to convey waste-fluid away from the urinal receptacle; and at least a portion of said water conduit or said waste-fluid conduit, or both, configured with a flexible material or a pivot coupling to accommodate repeated positionings of the urinal.

* * * * *